US006651905B2

(12) United States Patent
Sesser et al.

(10) Patent No.: US 6,651,905 B2
(45) Date of Patent: Nov. 25, 2003

(54) ADJUSTABLE ARC, ADJUSTABLE FLOW RATE SPRINKLER

(75) Inventors: George Sesser, Walla Walla, WA (US); Lee A. Perkins, Lowden, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 09/818,275

(22) Filed: Mar. 28, 2001

(65) Prior Publication Data

US 2002/0139868 A1 Oct. 3, 2002

(51) Int. Cl.[7] ..... B05B 15/10

(52) U.S. Cl. ..... 239/205; 239/222.17; 239/231; 239/247; 239/252; 239/456; 239/511; 239/580

(58) Field of Search ..... 239/203–206, 239/222.11–222.21, 231–233, 243–247, 252, 451–460, 511–514, DIG. 1, 579, 580, 581.1–581.2, 582.1

(56) References Cited

U.S. PATENT DOCUMENTS

| | | | | | |
|---|---|---|---|---|---|
| 3,131,867 | A | | 5/1964 | Miller et al. | |
| 3,583,638 | A | * | 6/1971 | Eby | 239/230 |
| 3,771,723 | A | * | 11/1973 | Ray | 239/230 |
| 3,884,416 | A | | 5/1975 | King | |
| 3,940,066 | A | | 2/1976 | Hunter | |
| 4,091,997 | A | * | 5/1978 | Ridgway | 239/206 |
| 4,119,275 | A | | 10/1978 | Hunter | |
| 4,154,404 | A | | 5/1979 | Clawson | |
| 4,261,515 | A | | 4/1981 | Rosenberg et al. | |
| 4,579,285 | A | | 4/1986 | Hunter | |
| RE32,386 | E | | 3/1987 | Hunter | |
| 4,687,139 | A | * | 8/1987 | Lockwood | 239/206 |
| 4,753,391 | A | * | 6/1988 | Rogers | 239/203 |
| 4,796,809 | A | | 1/1989 | Hunter | |
| 4,815,662 | A | | 3/1989 | Hunter | |
| 4,842,201 | A | | 6/1989 | Hunter | |
| 4,850,532 | A | | 7/1989 | Mackanos | |
| 4,867,379 | A | | 9/1989 | Hunter | |
| 4,898,332 | A | | 2/1990 | Hunter et al. | |
| 4,932,590 | A | | 6/1990 | Hunter | |
| 4,944,456 | A | | 7/1990 | Zakai | |
| 4,967,961 | A | | 11/1990 | Hunter | |
| 4,971,250 | A | | 11/1990 | Hunter | |
| 4,986,474 | A | | 1/1991 | Schisler et al. | |
| 5,031,840 | A | | 7/1991 | Grundy et al. | |
| 5,058,806 | A | * | 10/1991 | Rupar | 239/205 |
| RE33,823 | E | | 2/1992 | Nelson et al. | |
| 5,148,990 | A | | 9/1992 | Kah, Jr. | |
| 5,226,602 | A | | 7/1993 | Cochran et al. | |
| 5,288,022 | A | * | 2/1994 | Seser | 239/206 |
| 5,288,023 | A | | 2/1994 | Han et al. | |
| 5,360,167 | A | | 11/1994 | Grundy et al. | |
| 5,556,036 | A | | 9/1996 | Chase | |
| 5,647,541 | A | | 7/1997 | Nelson | |
| 5,718,381 | A | * | 2/1998 | Katzer et al. | 239/222.11 |
| 5,762,270 | A | | 6/1998 | Kearby et al. | |
| 5,823,440 | A | | 10/1998 | Clark | |
| 5,927,607 | A | | 7/1999 | Scott | |

* cited by examiner

*Primary Examiner*—Michael Mar
*Assistant Examiner*—Dinh Q. Nguyen
(74) *Attorney, Agent, or Firm*—Nixon & Vanderhye P.C.

(57) ABSTRACT

A sprinkler head includes a base having a lower and adapted for attachment to a sprinkler system component; an elongated steam supported within the base; a nozzle and a fixed deflector supported within the stem, the nozzle and deflector cooperating to define an adjustable arcuate orifice. A water distribution plate is supported on a shaft extending upwardly from the stem and has a plurality of water distribution grooves located in axially spaced relationship to the nozzle. An arc adjustment ring is rotatably mounted on the base and is operatively connectable with the nozzle for rotating the nozzle relative to the stem for adjustment of the arcuate discharge orifice. A throttle member is secured to the upstream end of the shaft such that rotation of the shaft causes the throttle to move relative to a portion of the stem, to thereby adjust flow rate through the nozzle.

108 Claims, 24 Drawing Sheets

ADJUSTABLE ARC, ADJUSTABLE FLOW RATE SPRINKLER

This invention relates to sprinklers and, specifically, to a sprinkler that incorporates adjustable arc and/or adjustable flow rate features.

BACKGROUND AND SUMMARY OF THE INVENTION

It is known to utilize interchangeable arc or other shaped nozzles in sprinklers in order to permit adjustment of the degree of coverage of the discharge stream, while maintaining a constant flow or precipitation rate in the watered areas. Typically, these nozzles comprise orifice plates which have a central hole for receiving a shaft that supports the distributor above the nozzle. The orifice itself is generally radially outwardly spaced from the shaft hole in the orifice plate. Representative examples of this type of construction are found in U.S. Pat. Nos. 4,967,961; 4,932,590; 4,842,201; 4,471,908; and 3,131,867. Other arc adjustment techniques are described in U.S. Pat. Nos. 5,556,036; 5,148,990; 5,031,840; 4,579,285; and 4,154,404.

It is also known to incorporate adjustable flow rate arrangements in sprinklers, within the context of a substantially constant water pressure. For example, see U.S. Pat. Nos. 5,762,270; 4,898,332; and 4,119,275. Such arc adjustment and flow rate adjustment features are often incorporated in pop-up sprinklers. Examples of pop-up sprinklers are found in U.S. Pat. Nos. 5,288,022; 5,058,806; 4,834,289; 4,815,662; and 4,790,481.

There remains a need, however, for a reliable sprinkler that incorporates an arc adjustment and/or a throw radius adjustment feature, and that provides constant precipitation rate and good uniformity, without excess leakage in the nozzle area.

The present invention relates to a sprinkler designed especially (but not exclusively) for incorporation in pop-up type sprinklers, and that provides within limits, essentially infinite arc adjustment and throw radius adjustment features, while at the same time, providing constant precipitation rates and good uniformity. The invention also provides a sprinkler that minimizes suckback plugging of the nozzle; permits active cleaning of the nozzle, and minimizes potential damage to critical internal components when, for example, impacted during use.

In one exemplary embodiment, the sprinkler head itself includes a nozzle, a rotary water distribution plate (or rotor plate) mounted on a shaft so as to be axially spaced from the nozzle. The rotor plate is formed with a plurality of curved, generally radial grooves that cause the rotor plate to rotate when impinged upon by a hollow, generally cone-shaped stream emitted from the nozzle. The rotor plate may incorporate a viscous damping mechanism to slow its rate of rotation.

In the pop-up embodiment, the nozzle and associated stream deflector are supported within a hollow stem which, in turn, is supported within a cylindrical base. A coil spring is located axially between a flange at the upper end of the stem and an arc adjustment ring at the upper end of the base. This coil spring biases the rotor plate, shaft, nozzle, deflector and stem to a retracted position relative to the base.

The shaft on which the rotor plate is mounted extends downwardly into and through the deflector, and is provided with an externally threaded sleeve fixed to the lower end of the shaft. A throttle member is threadably mounted on the fixed sleeve, so that rotation of the shaft will result in the throttle member moving axially upwardly or downwardly on the shaft, depending on the direction of rotation of the shaft, toward or away from a stop formed near the lower end of the stem.

The throw radius adjustment mechanism in the exemplary embodiment is implemented by flow rate adjustment, but, preferably, the arrangement is such that the flow cannot be completely shut off. In other words, even in a position where the throttle member is moved to its maximum restrictive position on an associated stop (and thus provide the smallest throw radius), enough water is permitted to flow through the base to the nozzle so that the rotor plate continues to rotate, albeit at a slower speed. This preferred configuration is intended to prevent stalling, a condition where the rotor plate ceases rotation as water pressure drops. The flow rate and hence throw radius adjustment is effected by rotation of the shaft by a suitable tool engageable with an end of the shaft that is externally accessible to the user. Aside from the flow rate adjustment function, the shaft is otherwise rotationally stationary during normal operation, i.e., the rotor plate rotates about the shaft.

The nozzle is rotatably mounted within the base, and cooperates with the stream deflector to define an arcuate water discharge orifice. The nozzle is operatively connected through a drive mechanism to the arc adjustment ring mounted on the top of the base, and externally accessible to the user. Thus, the user may rotate the arc adjustment ring to lengthen or shorten the arcuate length of the discharge orifice. It is presently contemplated that a pair of nozzle/deflector combinations may be employed to provide adjustable arcs between 90° and 210°, and between 210° and 270°. In accordance with another embodiment, the nozzle and deflector are further modified to provide a 360° or full circle pattern, and for this embodiment no arc adjustment is possible. Nevertheless, this latter embodiment may still include the above described flow rate adjustment feature. In the full circle version, the nozzle and stream deflector are modified, but all other components are retained, some to good advantage. The arc adjustment ring, for example, may be rotated to loosen and effect removal of debris lodged in the nozzle, without otherwise altering the arc of coverage.

The arc adjustment feature can be utilized only when the rotor plate is extended relative to the base. In other words, components of the drive mechanism are fully engaged only when the nozzle, deflector and stem move upwardly with the rotor plate to engage complementary drive components on the arc adjustment ring. This arrangement prevents accidental arc adjustment when the sprinkler is not in use, e.g., through contact with a lawn mower, weed trimmer or the like.

The rotor plate may also incorporate a known viscous dampening type "motor" (or "viscous retarder") that slows the rotation of the rotor plate, thereby increasing the throw radius of the stream.

When used in a pop-up type sprinkler, the invention employs a two-stage pop-up mechanism. First, the extendable tube of the pop-up assembly will extend as water under pressure is introduced into the assembly. After the tube extends out of the fixed riser, the rotor plate, nozzle, deflector and stem extend away from the base at the distal end of the extendable tube so that water emitted from the nozzle can be distributed radially by the rotor plate. This two-stage action is reversed when the flow of water is shut off, so that the rotor plate is in a retracted position that prevents any foreign matter from entering into the nozzle area before the extendable tube of the pop-up assembly is retracted.

Thus, in accordance with one aspect, the present invention relates to a sprinkler head comprising a base; a nozzle and a stream deflector supported within the base, the nozzle and stream deflector cooperating to define an adjustable arcuate discharge orifice; a water distribution plate supported on a shaft extending upwardly from the base, and adapted to be impinged by a stream emitted from the nozzle; and an arc adjustment ring rotatably mounted on the base, the arc adjustment ring operatively connectable with the nozzle for rotating the nozzle relative to the deflector for adjustment of the arcuate discharge orifice.

In another aspect, the present invention relates to a sprinkler head comprising a base; an elongated stem supported within the base; a nozzle and a stream deflector supported within the stem, the nozzle and stream deflector cooperating to define an arcuate orifice; a water distribution plate supported on a shaft extending upwardly from the base, the water distribution plate located in axially spaced relationship to the nozzle and adapted to be impinged by a stream emitted from the nozzle; and an adjustment throttle member secured to an upstream end of the shaft such that rotation of the shaft causes the throttle member to move relative to a flow restriction portion, to thereby adjust flow rate through the nozzle and a throw radius of the stream emitted from the nozzle.

In still another aspect, the present invention relates to a sprinkler head comprising a base; a nozzle and a stream deflector supported within the base, the nozzle and deflector cooperating to define an adjustable arcuate orifice; a water distribution plate supported on a shaft extending upwardly from the stem, the water distribution plate having a plurality of water distribution grooves therein located in axially spaced relationship to the nozzle and adapted to be impinged by a stream emitted from the nozzle; an arc adjustment ring rotatably mounted on the base, the arc adjustment ring operatively connectable with the nozzle for rotating the nozzle relative to the stem for adjustment of the arcuate discharge orifice; and a throttle member secured to an upstream end of the shaft such that rotation of the shaft causes the throttle to move relative to a flow restriction portion of the stem, to thereby adjust flow rate through the nozzle and a throw radius of the stream emitted from the nozzle.

In still another aspect, the present invention relates to an adjustable arc sprinkler head comprising a substantially cylindrical housing; a stream deflector supported in the housing; a nozzle located on the stream deflector and rotatable relative thereto, said nozzle having a first arcuate edge; wherein the stream deflector has a substantially hourglass shaped portion, tapering inwardly upstream of the first arcuate edge and tapering outwardly downstream of the first arcuate edge thereby establishing a second arcuate edge radially inwardly spaced from the first arcuate edge and defined by a smallest diameter of the hourglass shaped portion; the first and second arcuate edges defining an adjustable discharge orifice having an arcuate length, a downstream end of the stream deflector having a radially extending vertical tab with a first vertical surface forming one end of the adjustable discharge orifice, and a second vertical surface on the nozzle forming a second end of the adjustable discharge orifice, the first and second ends movable relatively toward and away from each other to thereby vary the arcuate length of the discharge orifice.

In still another aspect, the present invention relates to a pop-up sprinkler assembly comprising a first tubular member having an inlet end adapted for connection to a source of water under pressure; a second tubular member slidably mounted within the first tubular member and including a sprinkler head; a first coil spring located within the first tubular member arranged to bias the second tubular member to a retracted position within the first tubular member, the second tubular member movable to an extended position when water under pressure is admitted to the inlet end; the sprinkler head including an elongated stem; a nozzle supported on the stem; a water distribution plate mounted on a shaft projecting upwardly through the nozzle, the nozzle and the water distribution plate extendable relative to the second tubular member to an operative position; a second coil spring located in the sprinkler head, radially outwardly of the nozzle, supported at one end by a downstream end of the stem, and arranged to bias the water distribution plate to an inoperative position relative to the second tubular member.

In still another aspect, the present invention relates to a pop-up sprinkler assembly comprising a first tubular member having an inlet end adapted for connection to a pressurized water source; a second tubular member slidably mounted within the first tubular member for movement between retracted and extended positions; a first coil spring located within the first tubular member arranged to bias the second tubular member toward the retracted position within the first tubular member, the second tubular member movable to the extended position when water under pressure is admitted to the inlet end; a sprinkler head including a tubular base at an upper end of the second tubular member; an elongated stem supported within the base; a rotatable nozzle and a stream deflector supported within the stem, the nozzle and stream deflector cooperating to define an adjustable arcuate discharge orifice; a rotor plate supported on a shaft extending from the stem, the rotor plate having a plurality of water distribution grooves therein located in axially spaced relationship to the nozzle and adapted to be impinged by a stream issuing from the nozzle; an arc adjustment ring rotatably mounted on the base, the arc adjustment ring operatively connectable with the nozzle for rotating the nozzle relative to the stem for adjustment of the arcuate orifice; and a second coil spring radially outward of the nozzle and extending between a downstream end of the stem and the arc adjustment ring to thereby bias the rotor plate toward an inoperative position within the base, and movable to an operative position axially spaced from the base when water under pressure is admitted to the inlet end; and a throttle member secured to an upstream end of the shaft such that rotation of the shaft causes the throttle to move relative to a flow restriction portion of the stem, to thereby adjust flow rate through the nozzle and a throw radius of the stream emitted from the nozzle.

In still another aspect, the invention relates to a sprinkler head comprising a base having an upper end and a lower end, the lower end adapted for attachment to a sprinkler component; an elongated stem supported within the base and movable between retracted and extended positions; a nozzle and a stream deflector supported within the stem, the nozzle and deflector cooperating to define an arcuate discharge orifice adjustable through a predetermined arc; and an arc adjustment ring rotatably mounted on the base, the arc adjustment ring operatively connectable with the nozzle for rotating the nozzle relative to the stream deflector for adjustment of the arcuate discharge orifice; and wherein the arc adjustment ring is operatively connectable with the nozzle only when the stem is in the operative extended position.

In still another aspect, the invention relates to a sprinkler head comprising a base; a nozzle supported within the base; a water distribution plate supported above the nozzle for movement toward and away from the base; and at least one spring located substantially downstream of the nozzle and radially outwardly of the nozzle so as to be substantially outside the flowpath of a water flowing through the sprinkler head, the spring arranged to bias the water distribution plate toward the base.

In still another aspect, the invention relates to a sprinkler head comprising a base; a nozzle and a stream deflector supported within the base, the nozzle and stream deflector cooperating to define an adjustable arcuate discharge orifice; a water distribution plate supported on a shaft extending upwardly from the base, and adapted to be impinged by a stream emitted from the nozzle; and means for effecting relative movement between the nozzle and the stream deflector for adjusting an arcuate length of the discharge orifice.

Other objects and advantages of the subject invention will become apparent from the detailed description that follows.

DETAILED DESCRIPTION OF THE DRAWINGS

Figure 1:
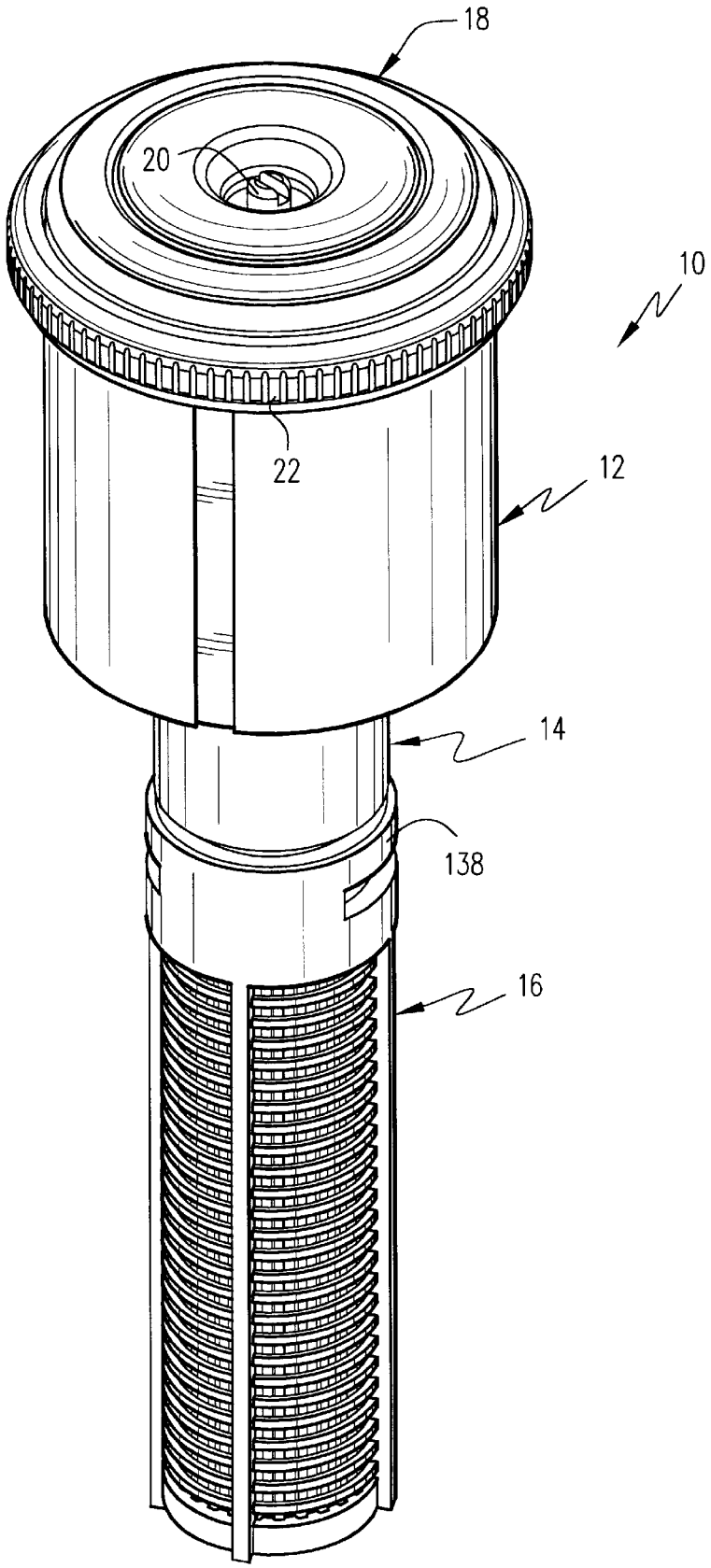
FIG. 1 is a perspective view of a sprinkler head in accordance with the invention.

FIG. 1 illustrates the sprinkler head 10 in accordance with an exemplary embodiment of the invention. The sprinkler head includes a base or housing 12 and a stem 14, with a conventional filter 16 attached to the lower end of the stem. Base 12 is adapted to be threadably attached to a pressurized water source that could include, for example, a fixed riser, a pop-up sprinkler stem, or other sprinkler system component or adapter, etc. In an alternative configuration, the base 12 could be made integral with a fixed riser, pop-up stem or other sprinkler system component. A water distribution plate 18 (or "rotor plate") is mounted in the base 12, with the plate 18 shown in a retracted, inoperative position in the Figure. A flow rate or throttle adjustment shaft 20 (preferably stainless steel) projects through the plate 18, while a rotatable arc adjustment ring 22 is secured to the top of the base 12. These and other internal components will be described in further detail below.

In the description that follows, it will be appreciated that references to "upper" or "lower" (or similar) in the descriptions of various components are intended merely to facilitate an understanding of the sprinkler head as it is oriented in the drawing figures, recognizing that the sprinkler head may be utilized in an inverted orientation as well.

Figure 2:
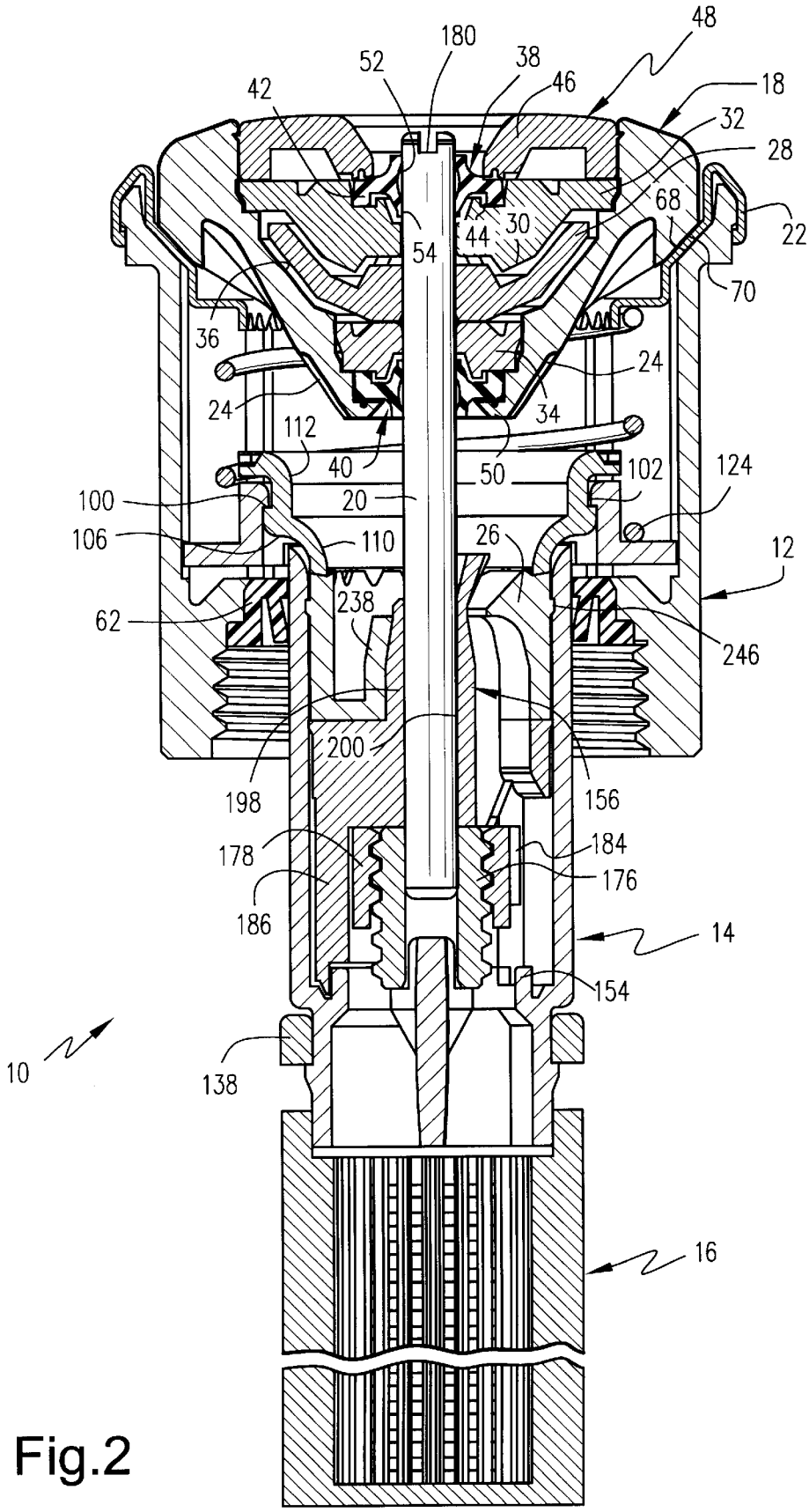
FIG. 2 is a cross section through the sprinkler head shown in FIG. 1.
Figure 33:
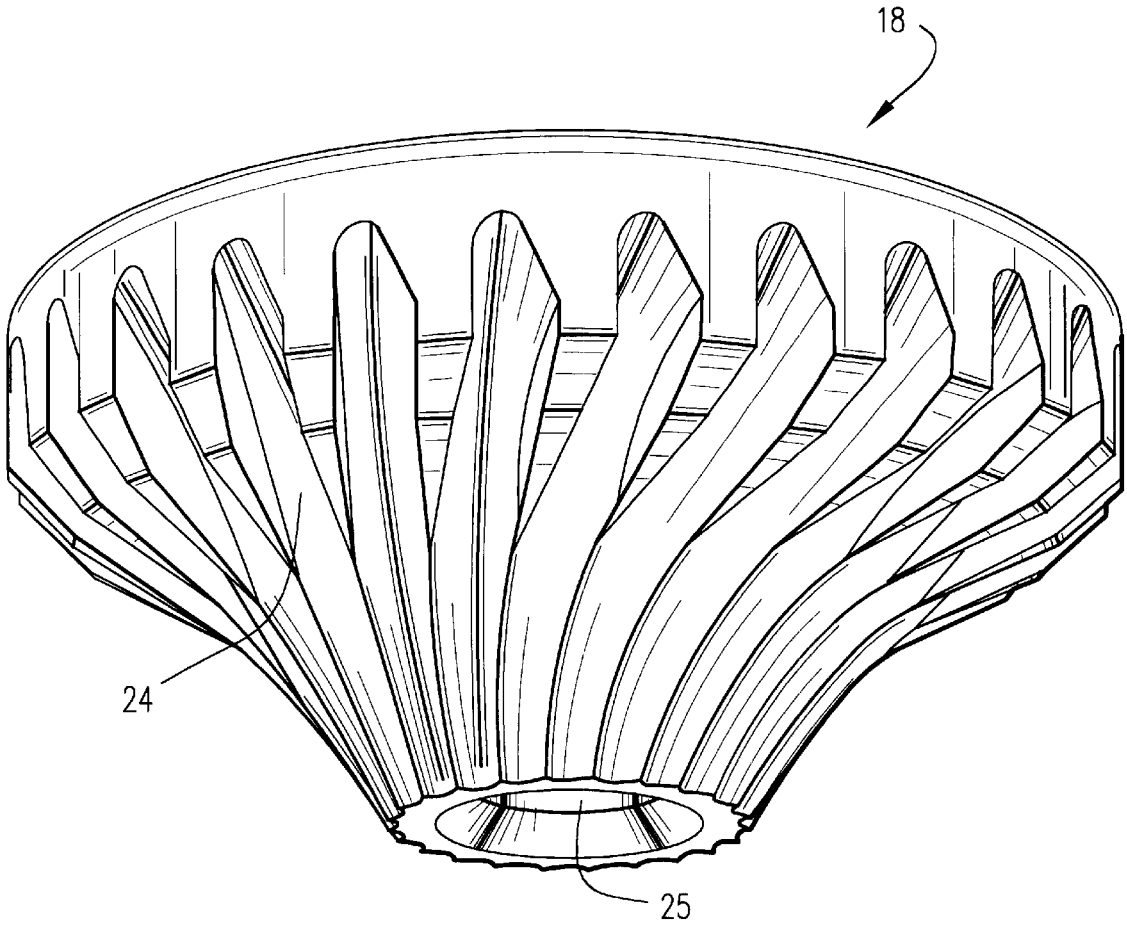
FIG. 33 is a perspective view of a rotor plate incorporated in the sprinkler head of FIGS. 1–3.
Figure 1:
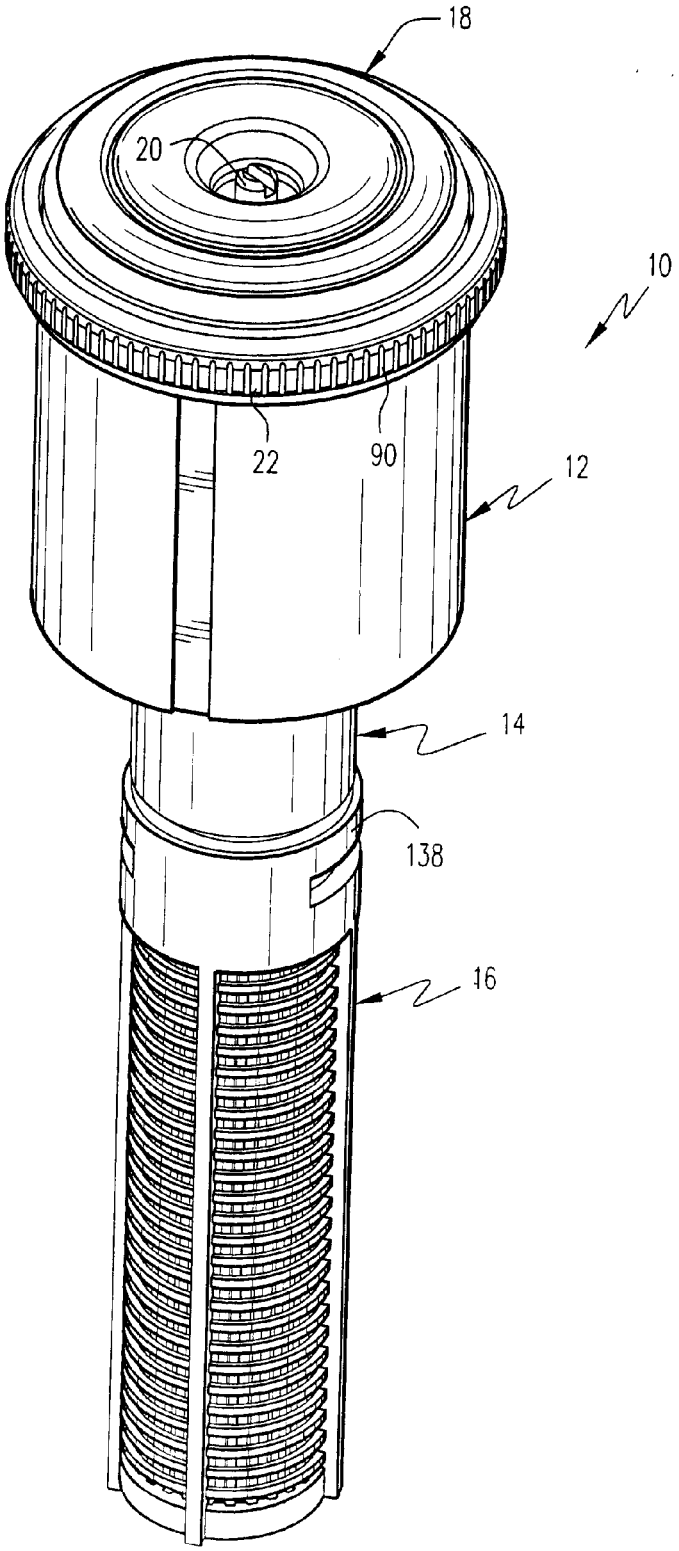
Figure 2:
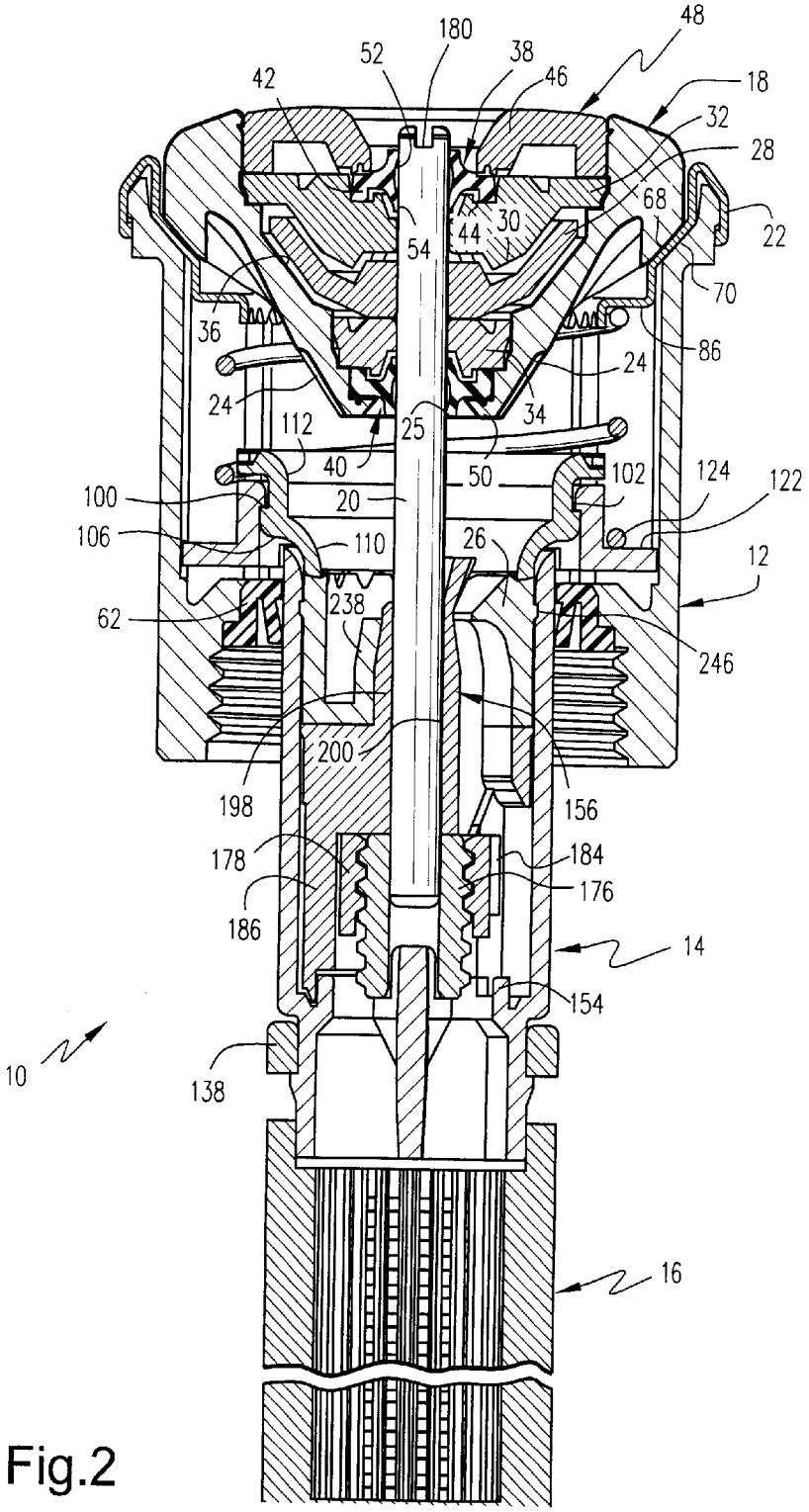
Figure 3:
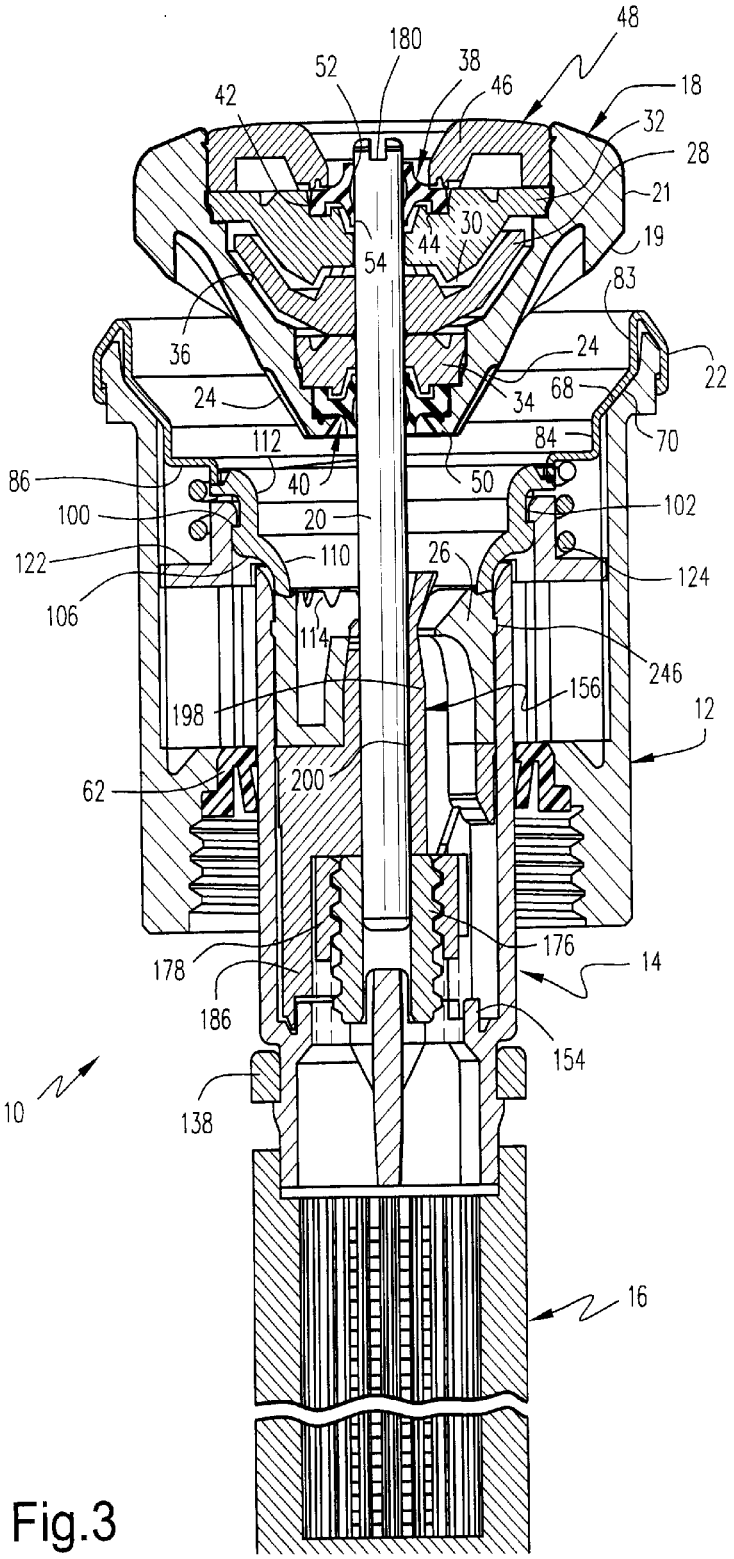
Figure 14:
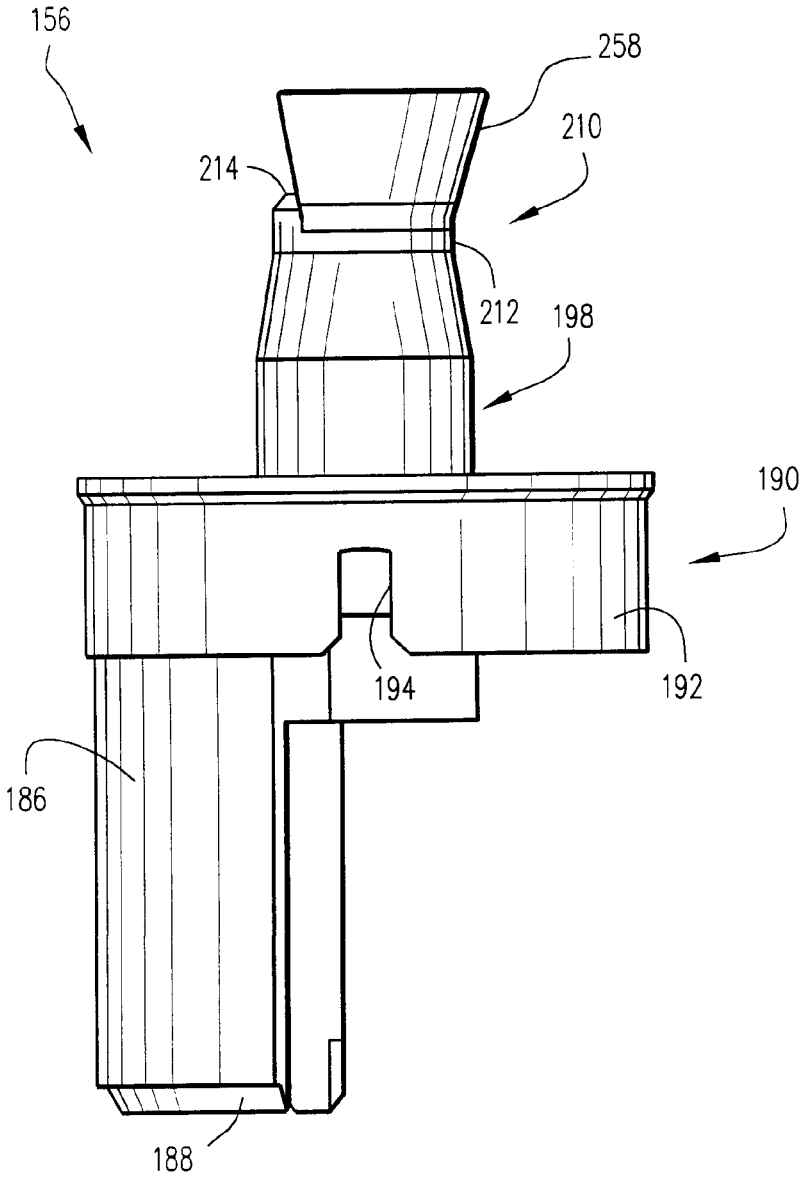
Figure 16:
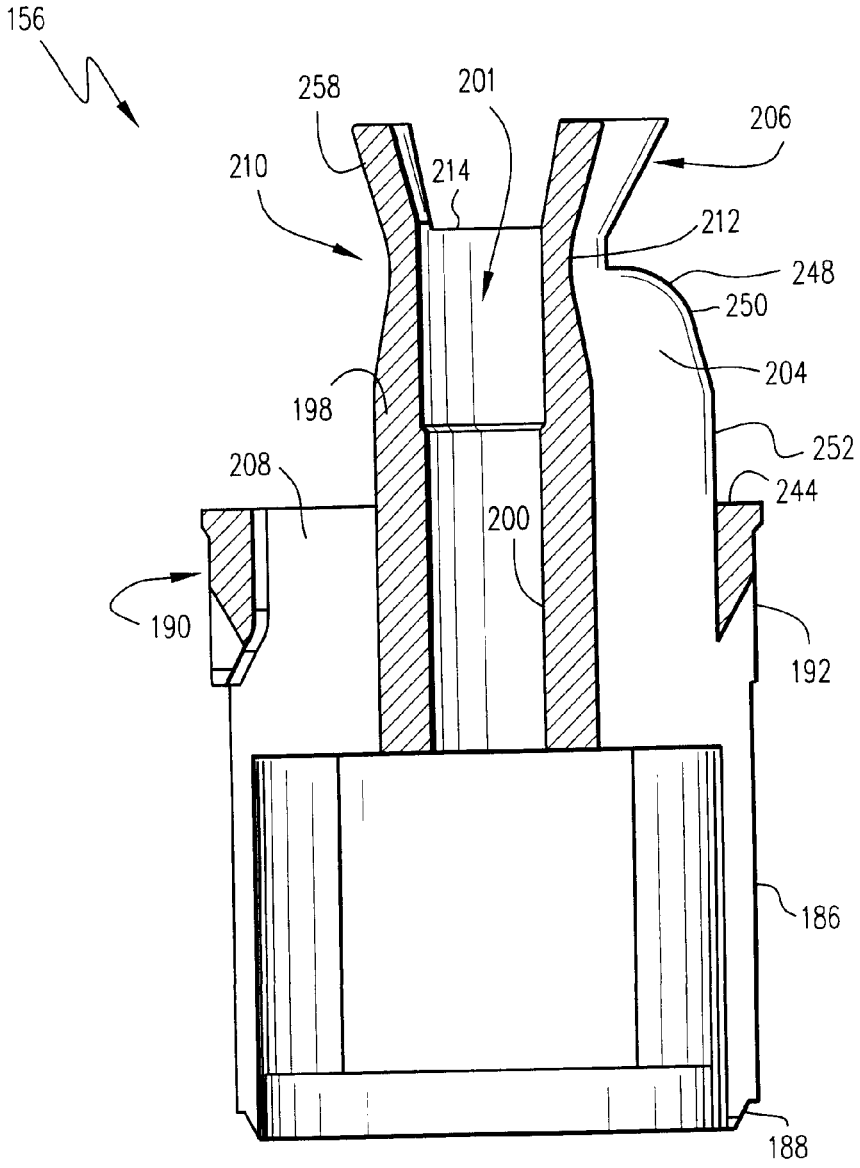
Figure 18:
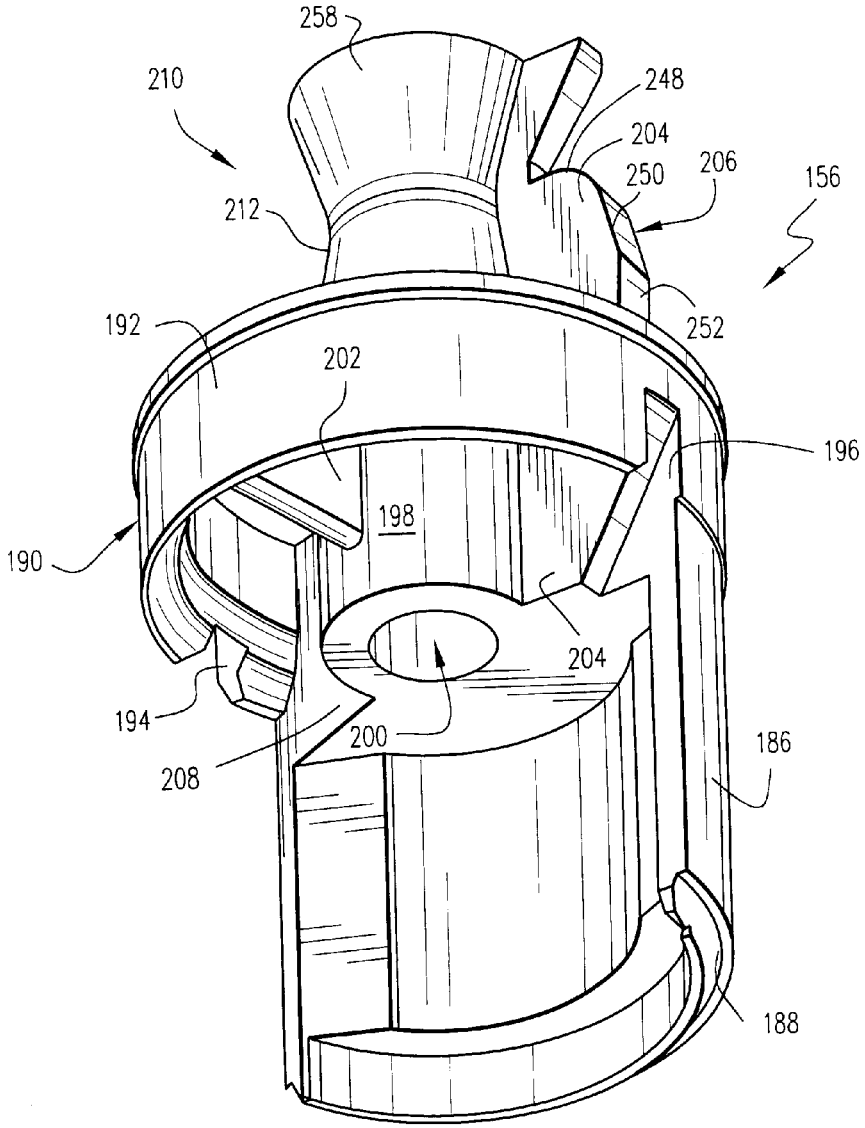
Figure 29:
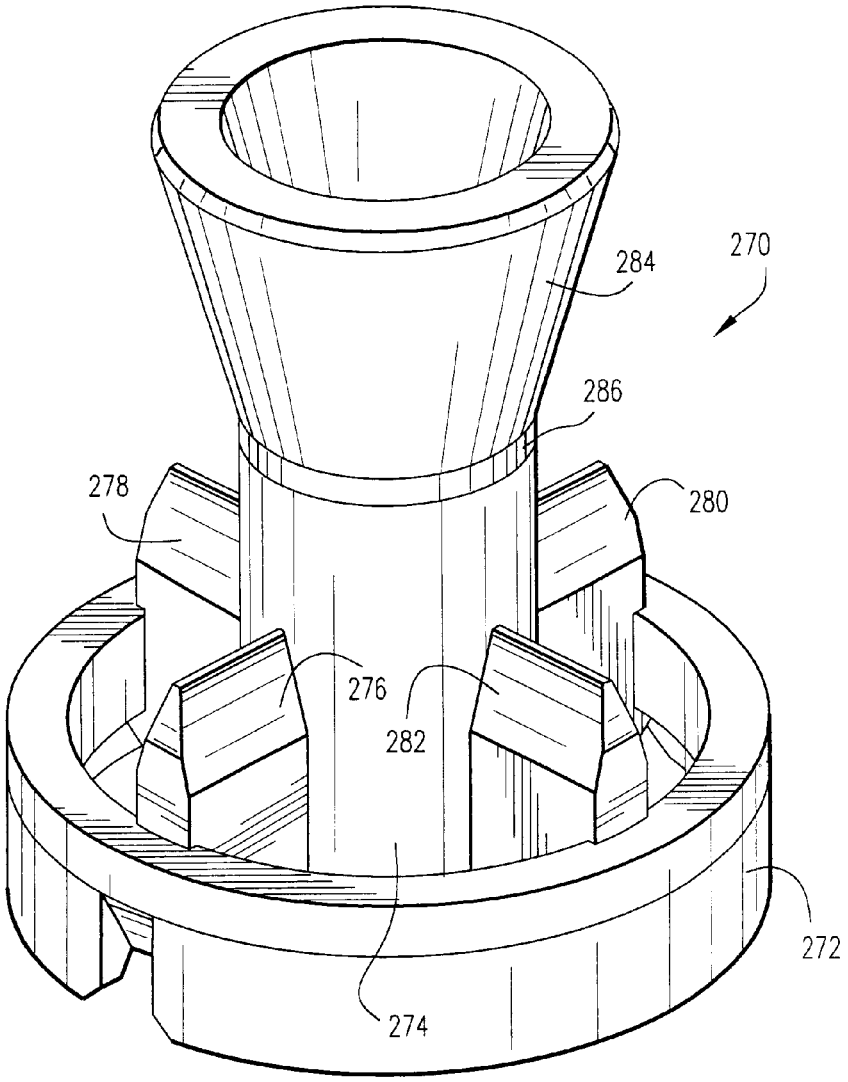
Figure 31:
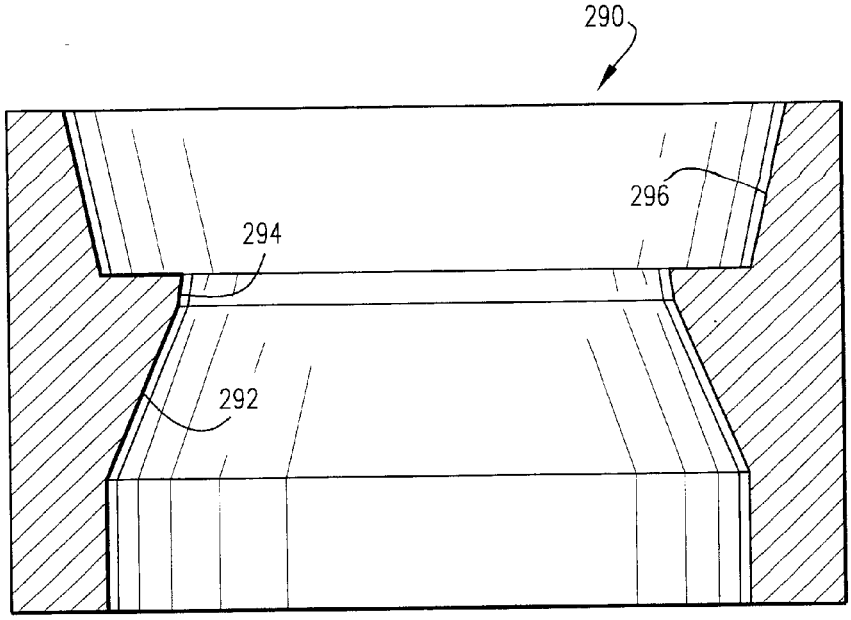
Figure 32:
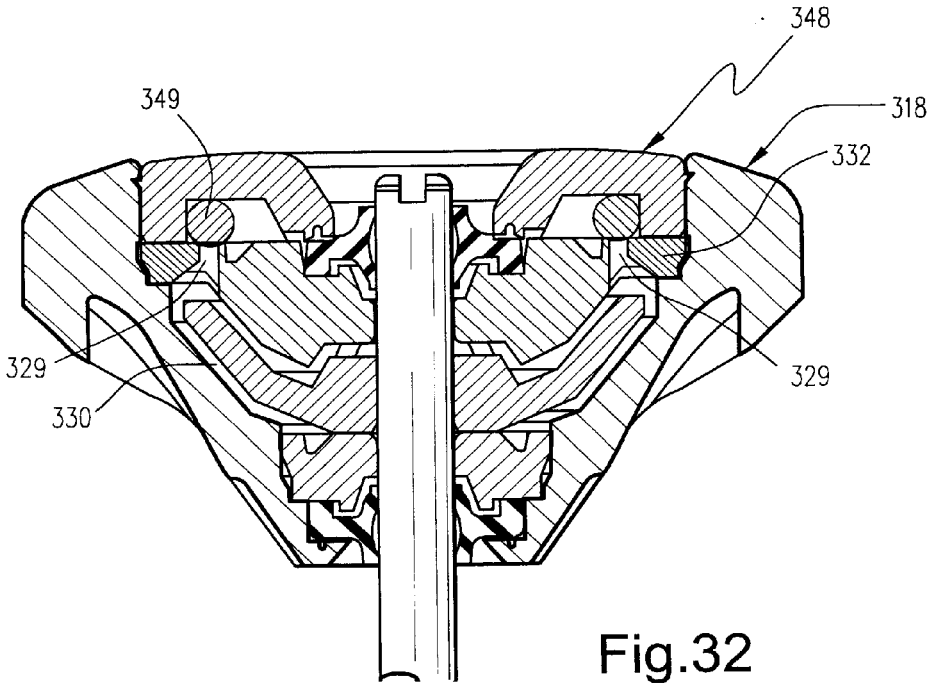

Turning to FIG. 2, the rotor plate 18 is mounted for rotation relative to the normally stationary shaft 20. Externally, the rotor plate 18 is formed with a series of generally radially oriented water distribution grooves 24 (see also FIG. 33) that extend angularly upwardly and radially outwardly from a lower end of the plate that is formed with a hole 25 for receiving the shaft 20. The grooves have lowermost entrance points that are preferably radially spaced from the shaft 20 in order to catch and distribute the stream emanating from a nozzle 26, and deflected outwardly by a stream deflector as discussed further herein. Grooves 24 are slightly curved and have a circumferential component best seen in FIG. 33, so that the rotor plate 18 is caused to rotate when the stream impinges on the plate.

The rotational speed of the rotor plate 18 in this embodiment may be slowed by a viscous dampening mechanism or "motor" (or "viscous retarder") similar to that described in commonly owned U.S. Pat. No. 5,058,806. The motor is incorporated into the rotor plate 18 and includes a generally cup-shaped stator 28 fixed to the shaft 20. The stator is located in a chamber 30 defined by upper and lower bearings 32, 34 as well as the interior surface 36 of the rotor plate 18. The chamber 30 is filled or partially filled with a viscous fluid (preferably silicone) that exhibits viscous shear as the rotor plate 18 rotates relative to the fixed stator 28, significantly slowing the rotational speed of the rotor plate as compared to a rotational speed that would be achieved without the viscous dampening motor. The viscous shearing action is enhanced by the shape of the upper bearing 32, the lower portion of which fits within, but remains spaced from, the cup-shaped stator 28.

The bearings 32, 34 are press-fit within the hollow rotor plate 18 so as to remain in place within the rotor plate. A very slight clearance between the shaft 20 and the bearings 32, 34 allows the rotor plate 18 to rotate relative to the shaft 20. At the same time, at least the upper bearing establishes a seal with the rotor plate 18 at the radially outer surface of the upper bearing. Upper and lower annular seals 38, 40 (preferably rubber) are mounted on the shaft and are provided for preventing leakage of silicone fluid out of the chamber 30, along the shaft 20. The seals are substantially identical, and thus only one need be described in detail. The upper seal 38 includes an outermost axial flange 42 by which the seal is secured between an annular groove 44 in the upper bearing 32 and a tapered, radially inner flange 46 on a retainer ring 48. The retainer ring 48 is also pressed and snap-fit within the rotor plate, preferably in permanent fashion. Lower seal 40 is similarly captured between lower bearing 34 and a radially in-turned flange 50 on the rotor plate, noting that lower seal 40 is inverted relative to the orientation of seal 38.

The seal 38 has a pair of axially spaced sealing surfaces 52, 54 that resiliently engage the shaft 20. In this regard, it is possible that some silicone fluid will run along the shaft 20 in an upward direction. Any such fluid will enter the space between the upper surface of the upper bearing 32 and the seal, but will not escape past the seal. A similar arrangement exists with respect to the lower bearing 34 and seal 40, where fluid may run due to gravity along the shaft and into the space between the lower bearing 34 and the seal 40. Seals 32 and 40 also serve to prevent foreign material from entering the chamber 30.

It will be appreciated that the sprinkler head could also employ a fixed water distribution or spray plate without any need for a viscous dampening motor.

Figure 4:
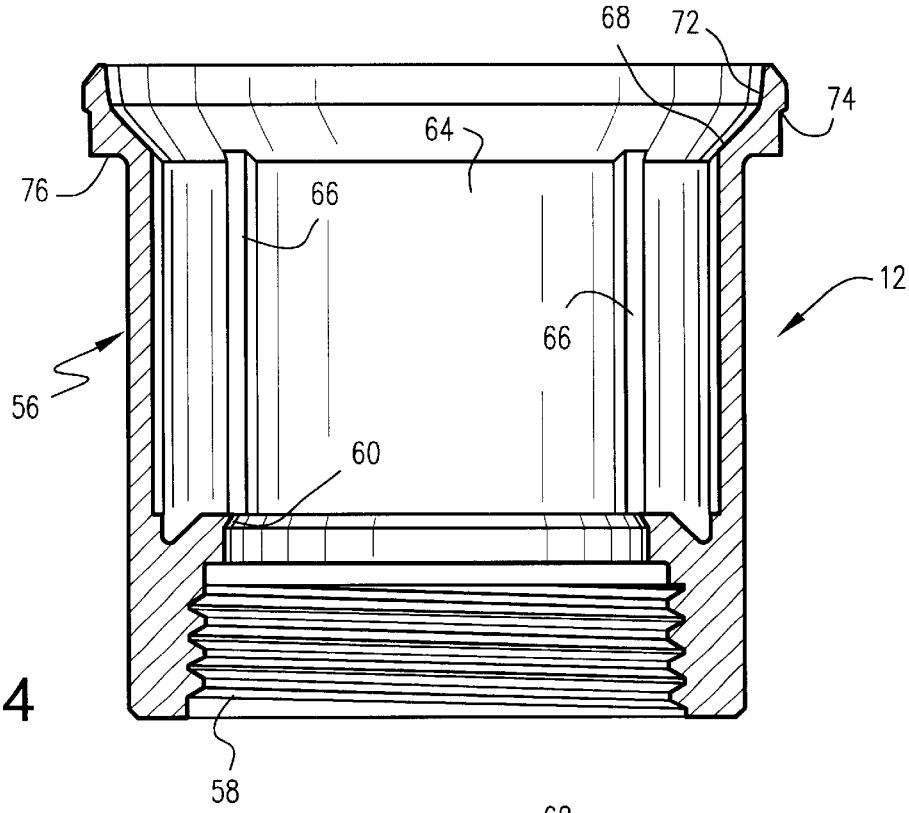
FIG. 4 is a side section through a base component of the sprinkler head shown in FIGS. 1–3.
Figure 5:
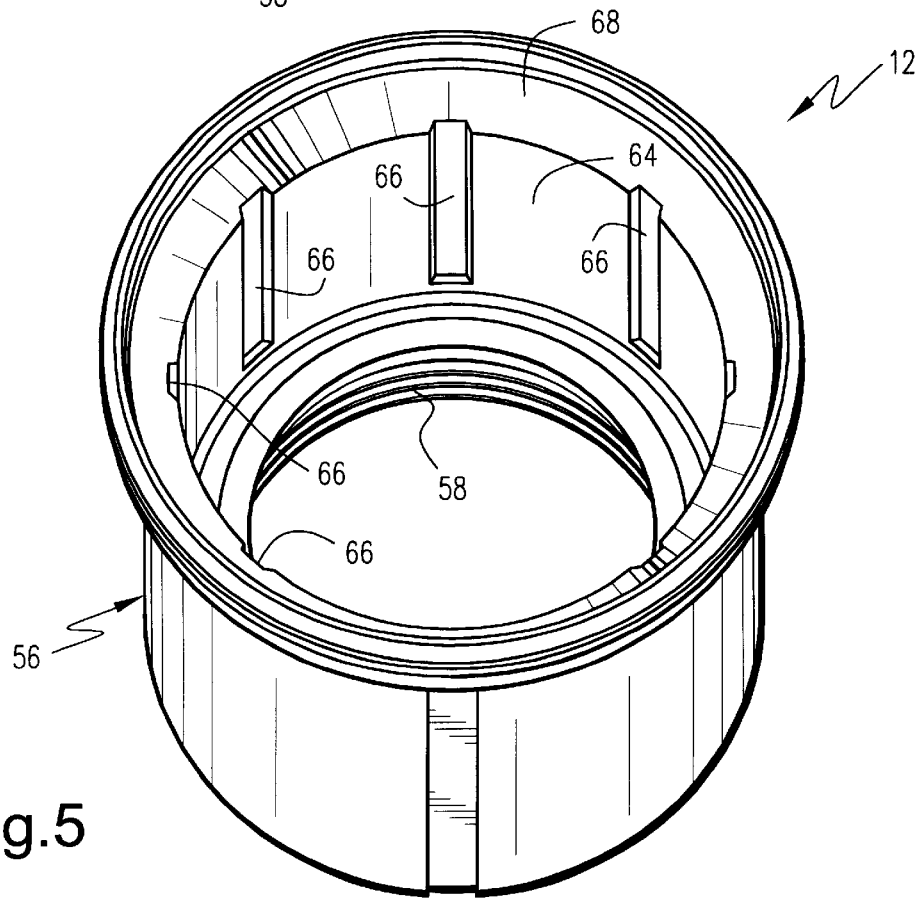
FIG. 5 is a perspective view of the base shown in FIG. 4.
Figure 27:
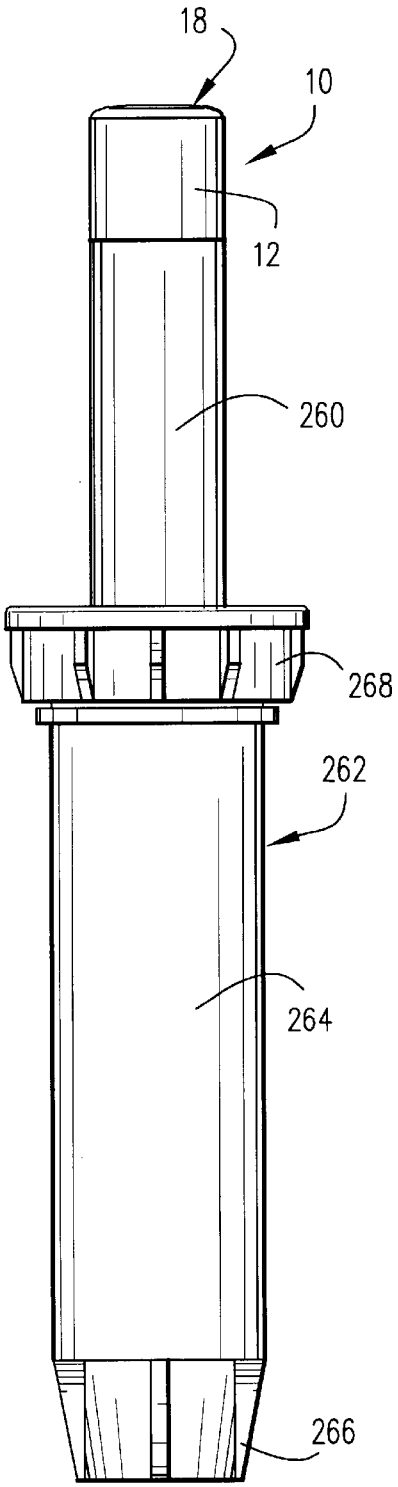
FIG. 27 is a side elevation of a pop-up sprinkler incorporating the sprinkler head in accordance with the invention.
Figure 28:
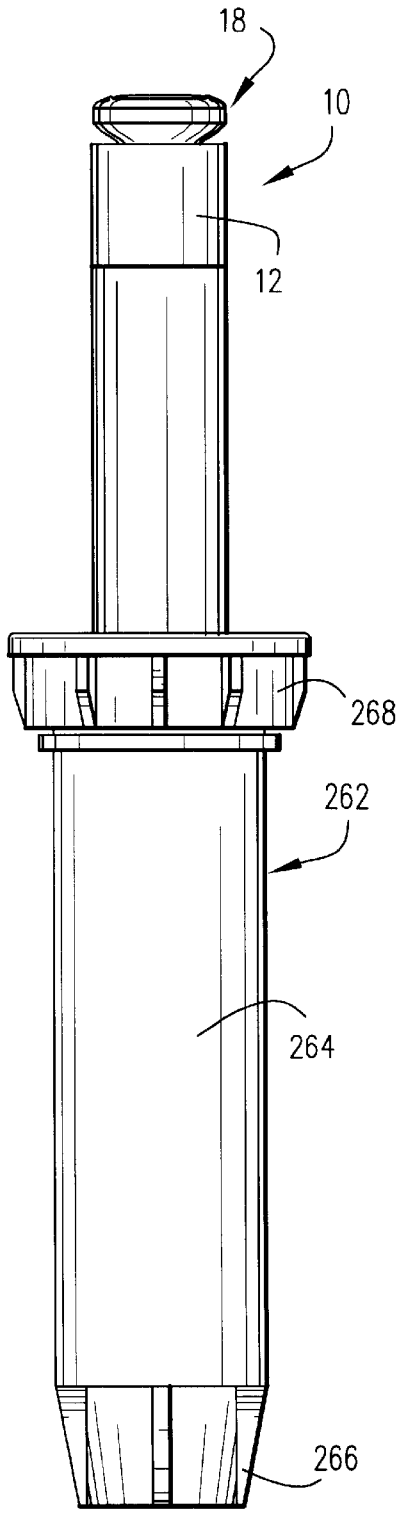
FIG. 28 is a side elevation similar to FIG. 27 but with the rotor plate in an extended, operative position.

Turning now to FIGS. 4 and 5, the base 12 includes a substantially cylindrical sleeve-like member 56 that is formed with an internally threaded inlet 58 by which the sprinkler head 10 may be attached to, for example, a conventional pop-up assembly, shown in FIGS. 27, 28, and discussed further herein (as already noted, the sleeve 56 could also be attached to a fixed riser or other sprinkler system component). The inlet 58 also includes a radially in-turned edge 60 that serves as an annular seat for a seal 62 (preferably 75 D urethane). The main portion of the base 12 is formed with a substantially smooth interior surface 64 that is interrupted by a plurality of unequally circumferentially spaced, axially extending grooves 66. The upper end of the base 12 is diametrically enlarged to include a radially outwardly and upwardly tapered surface 68 that serves as a seat for a similarly tapered surface 70 on the arc adjustment ring 22 when the rotor plate 18 is in the retracted, inoperative position shown in FIG. 1.

Surface 68 merges with a less sharply tapered rim 72 that has an undercut 74 on its outer side to facilitate retention of the arc adjustment ring 22 as explained further herein. A shoulder 76 is adapted to engage an annular surface on the pop-up sprinkler body. As also explained further below, the axially extending internal grooves 66 on the base 12 are used to locate the stem 14 and to insure that the latter does not rotate relative to the base 12.

Figure 3:
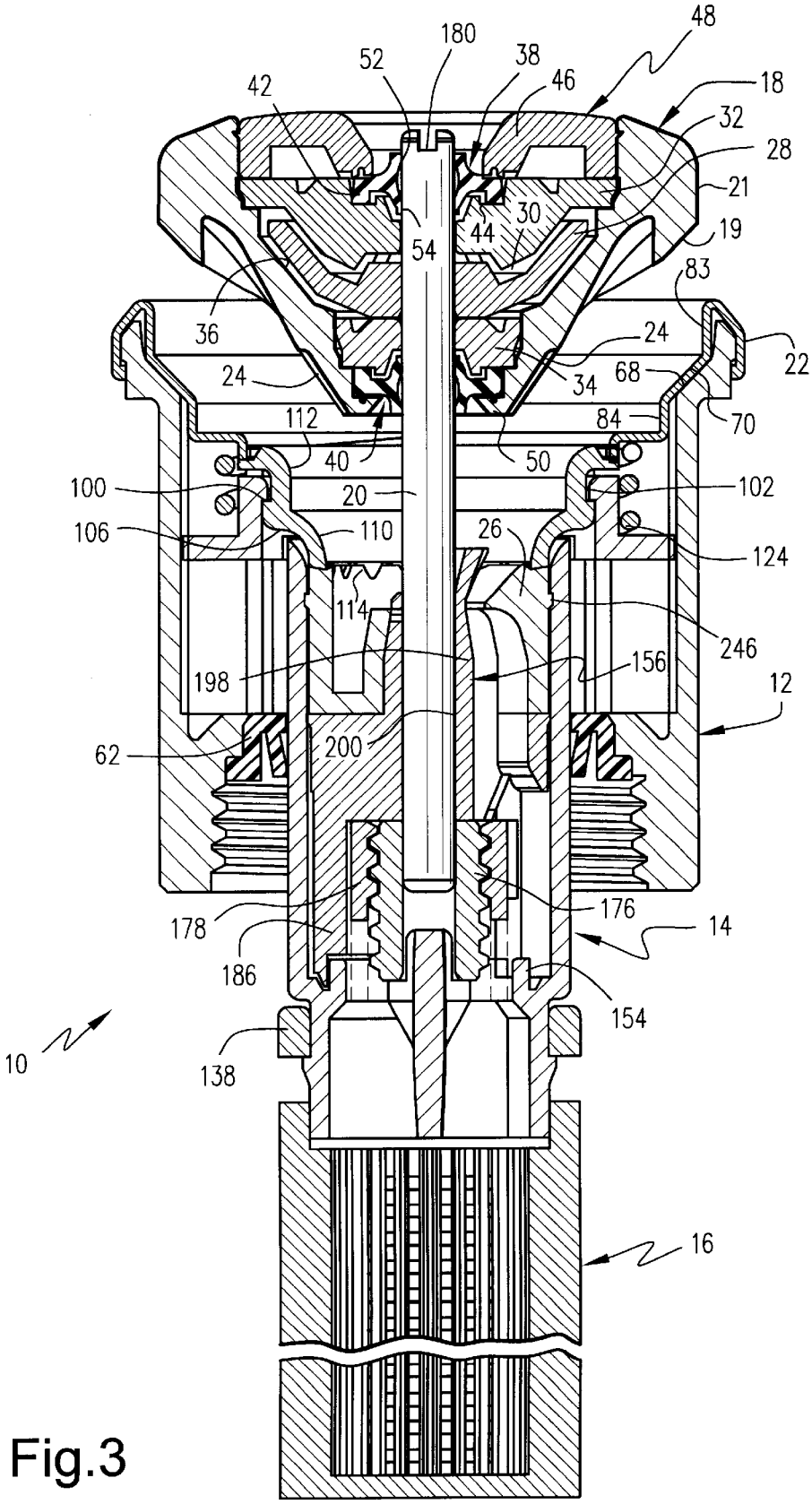
FIG. 3 is a cross section similar to FIG. 2 but with the rotor plate in an extended, operative position.
Figure 6:
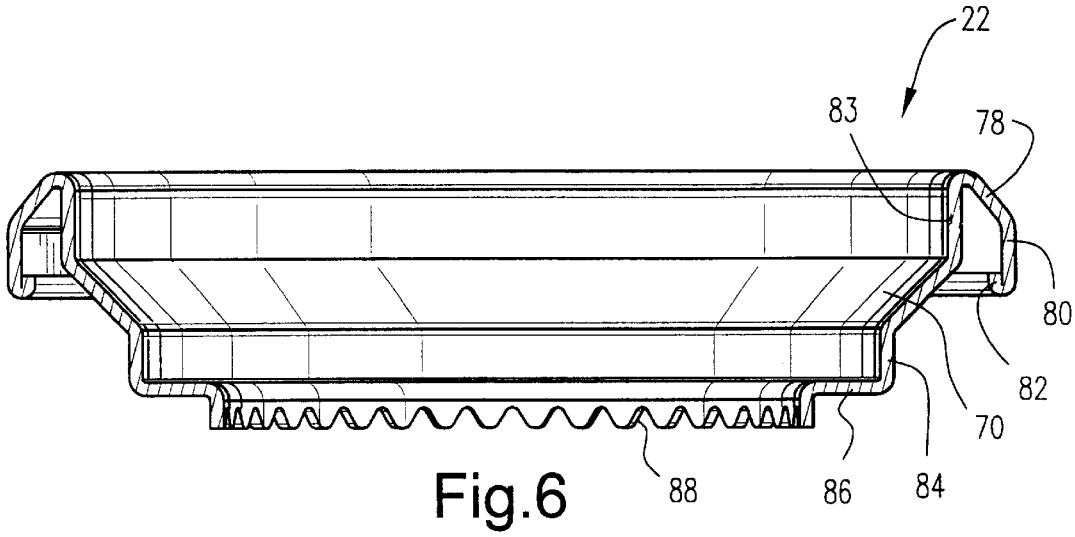
FIG. 6 is a cross section through an arc adjustment ring incorporated in the sprinkler head shown in FIGS. 1–3.
Figure 7:
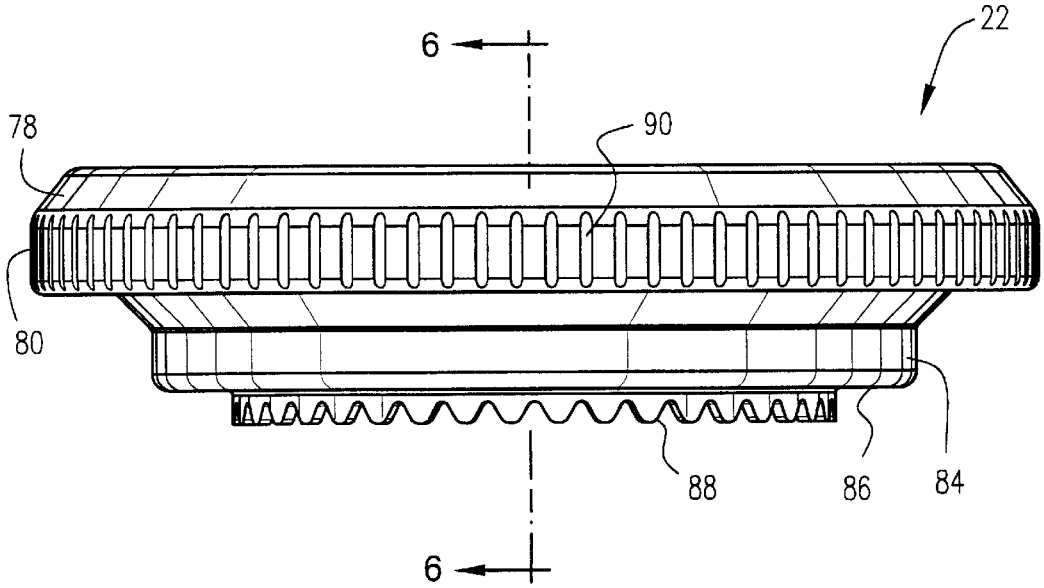
FIG. 7 is a side elevation of the arc adjustment ring shown in FIG. 6.

The arc adjustment ring 22 shown in FIGS. 2 and 3 but best seen in FIGS. 6 and 7, includes an upper radially outturned rim 78 that is adapted to fit over the upper rim 72 of the base 12. Rim 78 includes a depending skirt 80 that forms the outer diameter of the ring 22. The lower end of skirt 80 is provided with a radially in-turned curl 82 engaged in the undercut 74 such that the arc adjustment ring 22 is rotatable, but otherwise axially fixed relative to the base. The previously described tapered surface 70 extends downwardly and inwardly from a first axial portion 83 to a second axial portion 84 and radial wall 86 that extends inwardly to an annular row of gear teeth 88 that are used in the implementation of the arc adjustment capability as described further below. The row of teeth form the radially inner diameter of the ring 22. To facilitate rotation of the ring 22, the outer and axially extending surface of the rim 78 may be formed with a series of closely spaced grooves 90 (or similar tactile surface enhancements), best seen in FIGS. 1 and 7.

Figure 8:
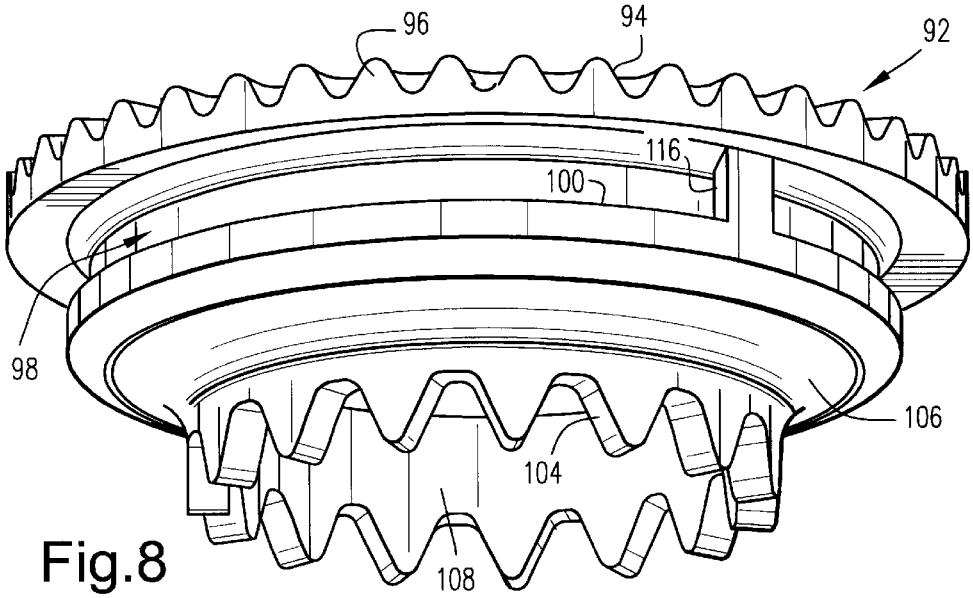
FIG. 8 is a perspective view of an intermediate drive component incorporated in the sprinkler head shown in FIGS. 2 and 3.

With reference now to FIG. 8, and with continuing reference to FIGS. 2 and 3, an arc adjustment actuator or drive ring 92 is axially interposed between the arc adjustment ring 22 and the nozzle 26. The drive ring 92 is formed with a first upwardly facing annular row of teeth 94, the outer surface 96 of which forms the outer diameter of the ring 92. An undercut or groove 98 on the outer surface of the ring provides an annular seat or shoulder 100 (FIGS. 2 and 3) adapted to receive radially inwardly directed ribs 102 on the stem 14 (FIGS. 2 and 3). A second annular row of teeth 104 project downwardly from the lower end of the ring, spaced radially inwardly of the upper row of teeth and seat 100 by the radial flange 106. The inner surface 108 defines the inner diameter of the ring.

The upper row of teeth 94 are adapted to mesh with the row of teeth 88 on the arc adjustment ring 22, but only when the rotor plate 18 is extended as shown in FIG. 3. The lower row of teeth 104 is adapted to always mesh with an upper row of teeth 114 on the nozzle 26 as described further below. In an alternative arrangement, the drive ring 92 could be made integral with the nozzle 26, eliminating the teeth 104 and 114.

A vertical rib 116 in the groove 98 limits rotation of the ring 22 and nozzle 26 by engaging a selected edge of one of the radially inwardly directed ribs 102. As will be explained further below, this rib insures that the nozzle 26 will not be over-rotated when adjusting the arc of coverage, thus greatly minimizing the possibility of undesirable leakage through the nozzle area.

FIGS. 9–12 illustrate the stem 14 in further detail. With continuing reference also to FIGS. 2 and 3, and as already mentioned, the stem 14 is formed at its upper end with a pair of the circumferentially spaced, radially inwardly directed, arcuate ribs 102. These ribs extend from an outer cylindrical wall 118 that extends downwardly to a radial flange 120 that provides a seating surface 122 for a coil spring 124. The flange 120 includes a plurality of circumferentially spaced, laterally extending teeth or ribs 126 that are unequally spaced about the flange 120 so as to match (in a single matched orientation) the unequally spaced axial grooves 66 formed in the base. This arrangement serves to circumferentially orient the stem 14 relative to the base 12 in the desired manner during assembly.

In order to form the arcuate, radially inwardly directed ribs 102, slots 128, 130 are formed at the root of the corresponding flange 120, thus permitting access by forming tools during manufacture.

Below flange 120, the stem 14 is made up of a substantially cylindrical tubular portion 132, with a lower end having an annular groove 134 and a reduced diameter portion 136. Groove 134 is adapted to receive an upper end 138 of the filter 16 in snap-fit relationship (best seen in FIGS. 2 and 3). Interiorly, the tubular portion 132 is formed with a pair of diametrically opposed ribs 140, 142, each having respective tapered top portions 144, 146, extending radially inwardly from the interior surface 148 of the tubular portion 132. At their lower ends, the ribs 140, 142 are connected by a cross web 150 that extends diametrically across the inlet opening 152 of the stem.

Figure 9:
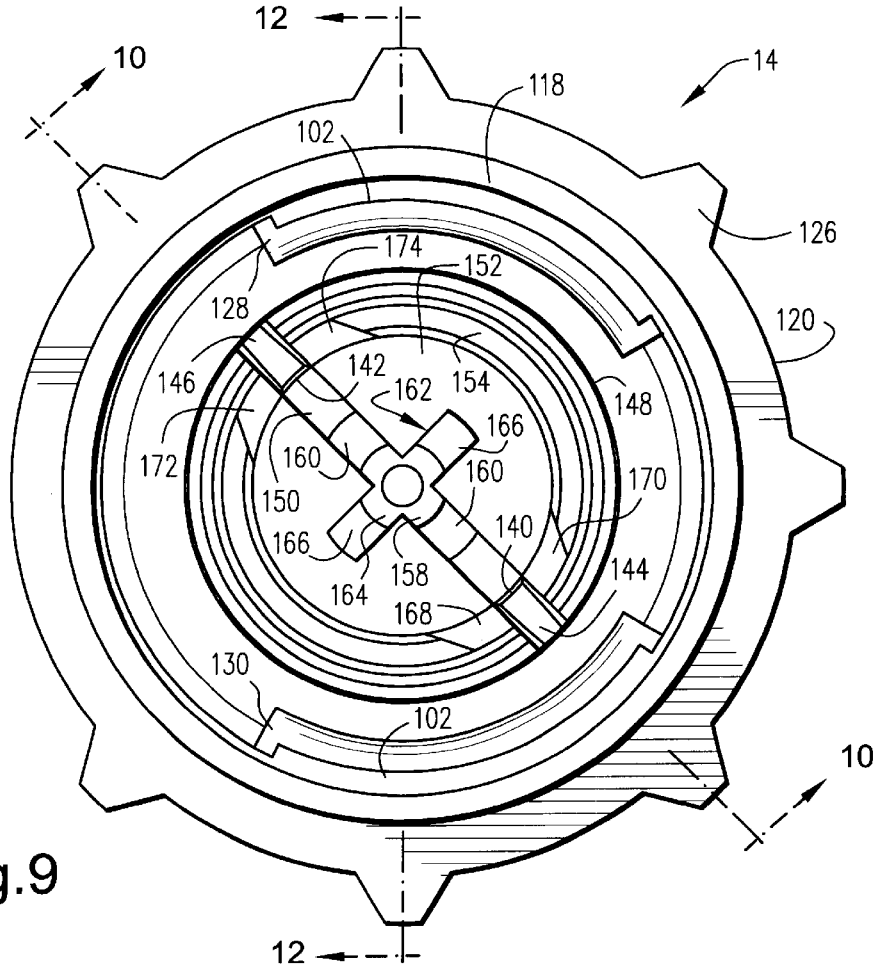
FIG. 9 is a plan view of a stem component incorporated in the sprinkler head shown in FIGS. 1–3.
Figure 10:
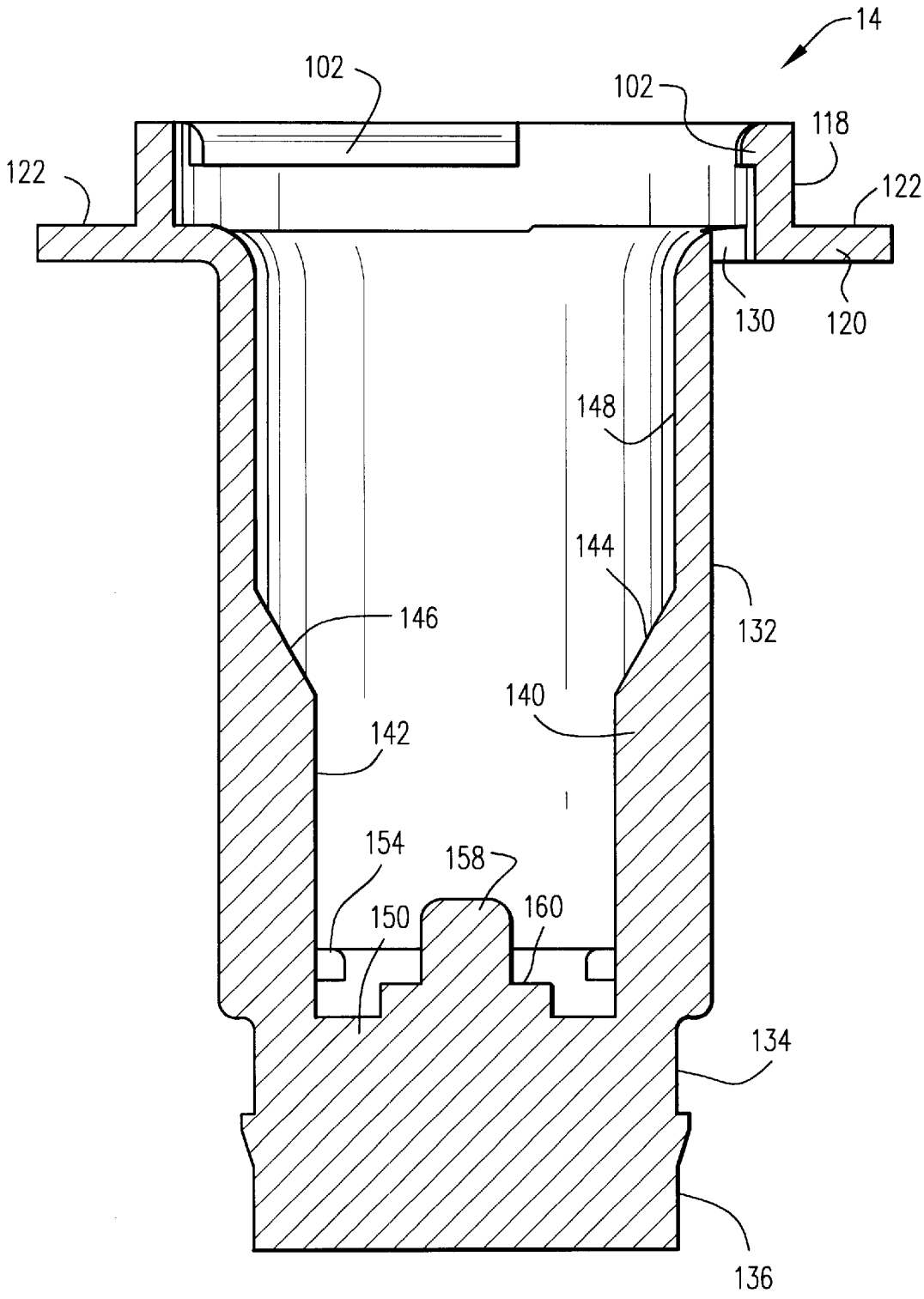
FIG. 10 is a section taken along the line 10—10 of FIG. 9.
Figure 11:
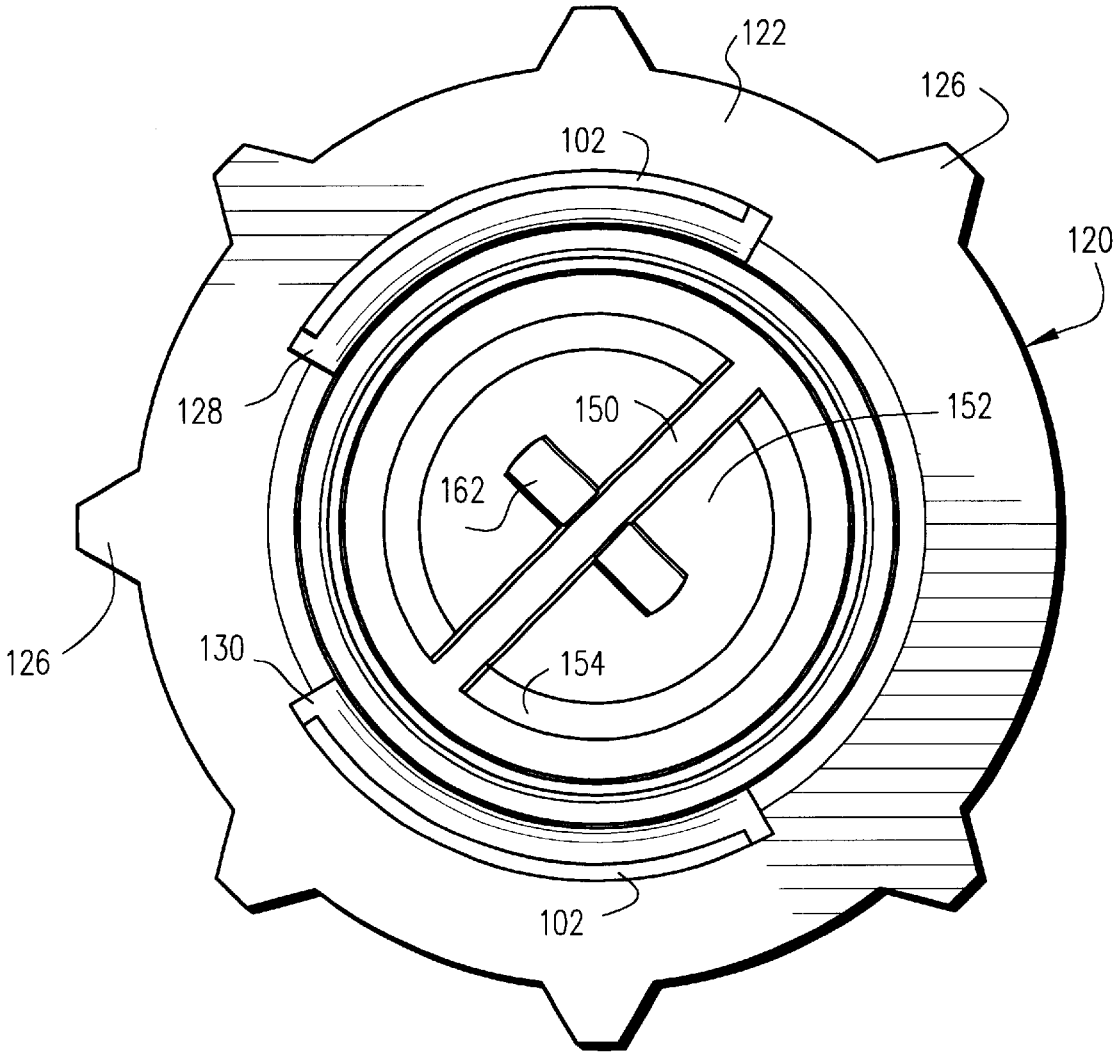
FIG. 11 is a bottom plan view of the stem shown in FIG. 9.
Figure 12:
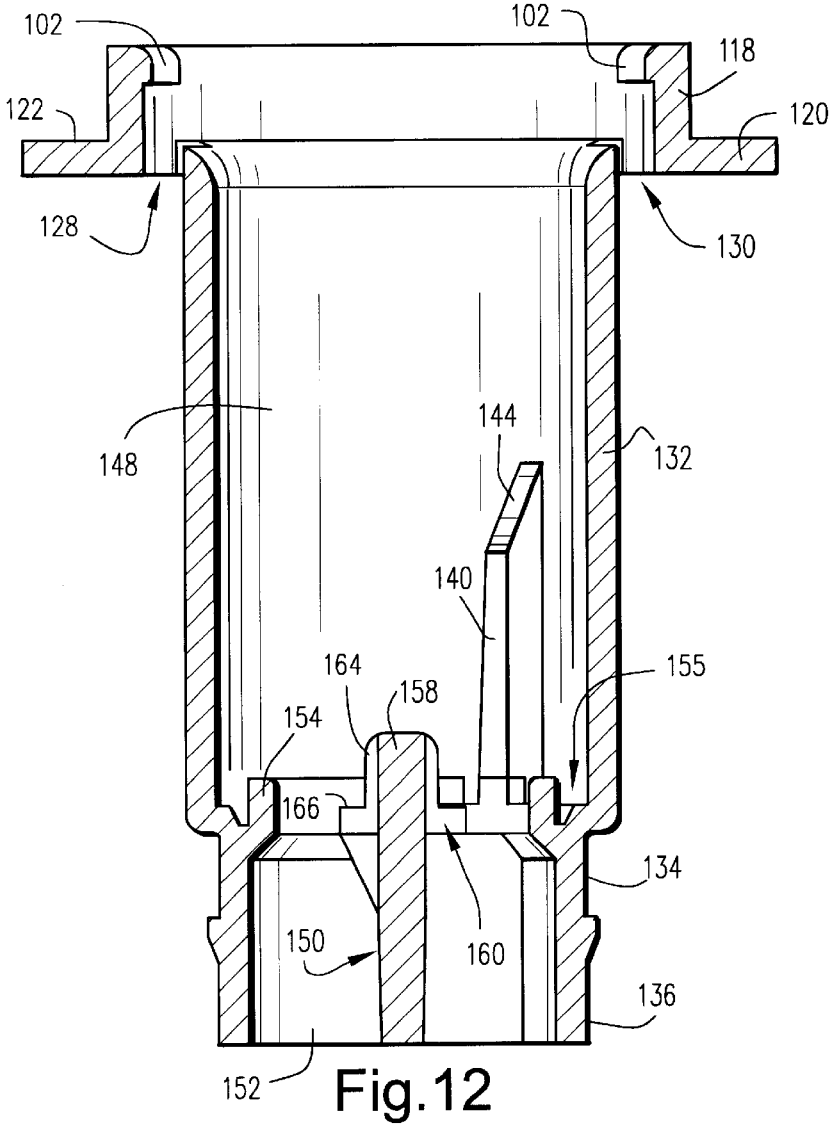
FIG. 12 is a section taken along the line 12—12 in FIG. 9.

Opening 152 is defined by an annular ring or shoulder 154, spaced radially inwardly of surface 148, that extends approximately 180° on either side of the web 150, and that provides a seat 155 for the lower end of a stream deflector 156 described further herein. The web 150 is formed with a raised center boss 158 and intermediate, adjacent ledges 160 (FIG. 10). This construction is continued on a radially shortened cross piece 162 that extends perpendicular to the web 150, terminating at distal ends that lie approximately halfway between the center boss 158 and the interior shoulder 154. This cross piece 162 has a similar raised center surfaces 164 that join with the boss 158, and intermediate, adjacent ledges 166. Thus, the combined center boss 158, 164 and associated intermediate ledges 160, 166 form an X or cross-shape. The annular shoulder 154 is formed with recessed areas 168, 170 (FIG. 9) adjacent rib 140 and similarly recessed areas 172, 174 adjacent rib 142. This construction at the base of the stem facilitates the flow rate adjustment feature of the sprinkler as described further below.

Returning to FIGS. 2 and 3, the shaft 20 extends downwardly through the nozzle 26 and through the stream deflector 156. The lower end of the shaft is provided with an externally threaded sleeve 176 (preferably brass) that is pressed onto the shaft so as to be fixed thereto. It may be possible, however, to have sleeve 176 made integral with the shaft. The sleeve rests on the intermediate ledges 160, 166. An internally threaded throttle control member 178 (see also FIG. 13) is threadably received on the axially fixed sleeve 176, such that rotation of the shaft 20 causes the throttle control member 178 to move toward or away from the cross web 150, depending upon the direction of the rotation of the shaft. A slot 180 at the top of the shaft enables rotation of the shaft by a screw driver or similar tool.

It will be seen that as the throttle control member moves toward a flow restriction portion which, in this case, is the annular shoulder 154 and cross web 150, the cross-sectional area available for flow, and hence the flow rate through the sprinkler, decreases, and reaches a minimum when the throttle control member is seated on the cross web, or stop, 150. In this position, however, there is still sufficient flow around the stream deflector 156 and through the stem 14 and nozzle 26 to rotate the rotor plate 18, albeit at a reduced speed. This arrangement prevents the device from stalling, i.e., from stopping when the flow rate is significantly reduced. Note that shaft 20 is stationary during normal operation, and is rotatable only to adjust the flow rate.

Figure 13:
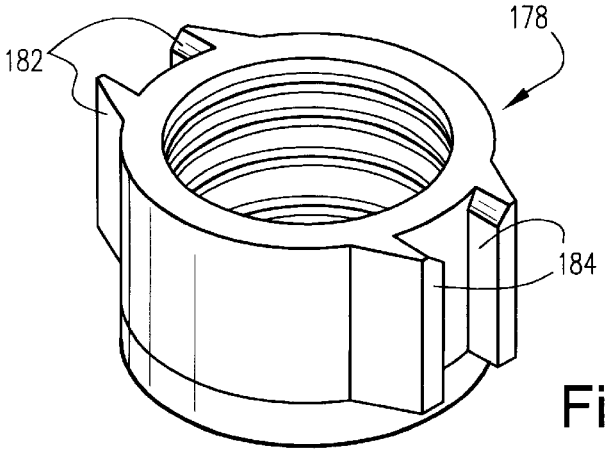
FIG. 13 is a perspective view of a throttle member incorporated in the sprinkler head shown in FIGS. 2 and 3.

The throttle control member 178, as best seen in FIG. 13, is formed with pairs of diametrically opposed ears 182, 184 that locate along the ribs 140, 142 to guide the throttle member 178 axially and to prevent rotation thereof. The ears are adapted to seat in the recessed areas 168, 170 and 172, 174 on opposite sides of the respective ribs 140, 142 when the throttle control member is in its most restrictive position.

Note also that the raised boss 158, 164 extends into the hollow sleeve 176 to maintain proper vertical alignment of the shaft 20.

Turning now to FIGS. 14–19, along with FIGS. 2 and 3, the stream deflector 156 is received within the stem 14 and cooperates with the nozzle 26 to define an arcuate water discharge orifice (see 259 in FIGS. 25 and 26) with an adjustable arcuate length. As already noted, the lower or tail end 186 of the deflector is formed with a tapered edge 188 supported in the groove 155 at the base of the stem 14. The stream deflector 156 also includes an annular ring 190 approximately mid-way along its axial length. A skirt portion 192 of the ring is formed with a pair of notches 194, 196 that open along the bottom edge of the skirt and are adapted to receive the tapered upper ends 144, 146 of the ribs 140, 142. This arrangement fixes the stream deflector 156 against rotation.

Figure 16:
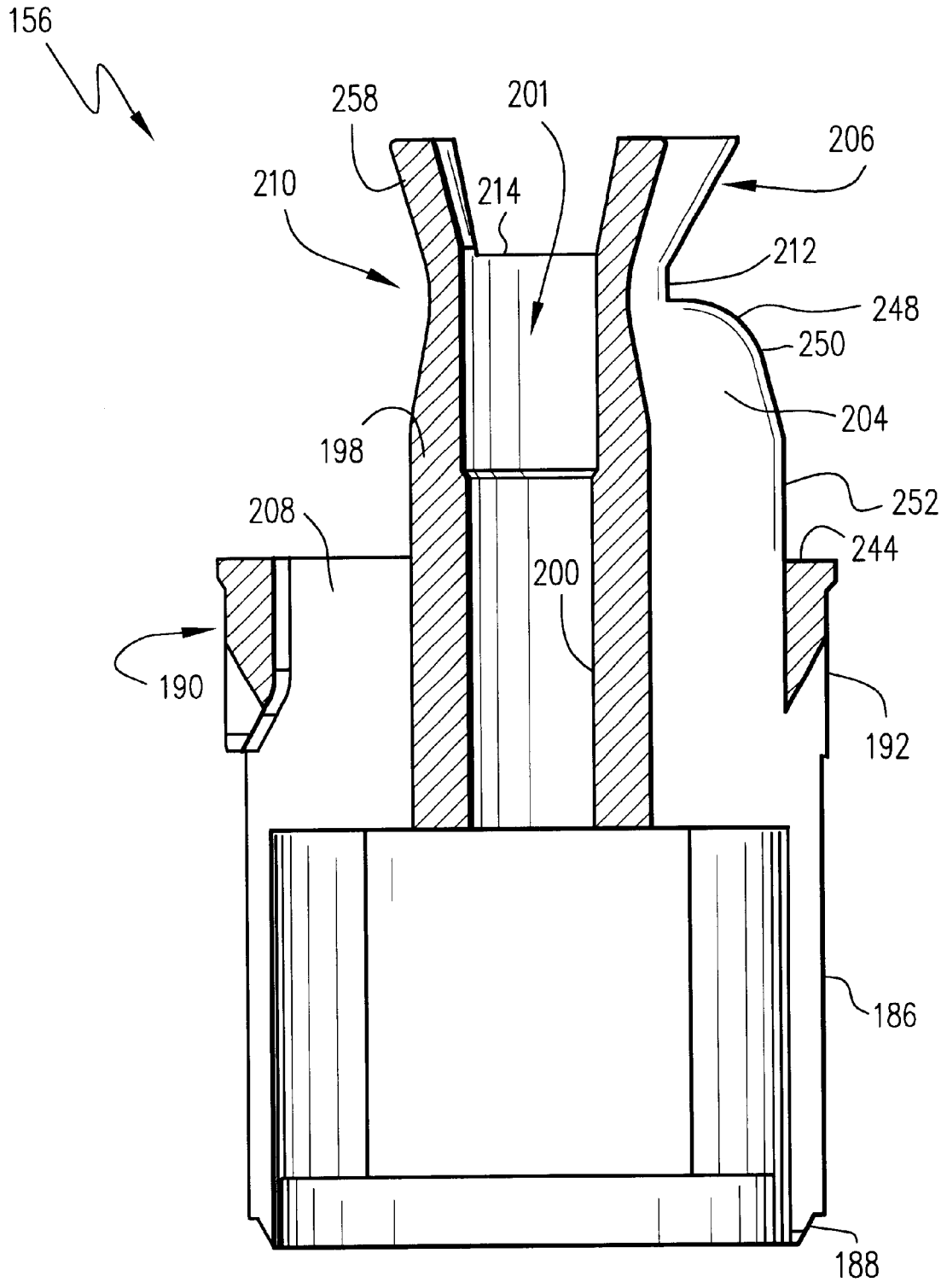
FIG. 16 is a section taken along the line 16—16 of FIG. 15.
Figure 17:
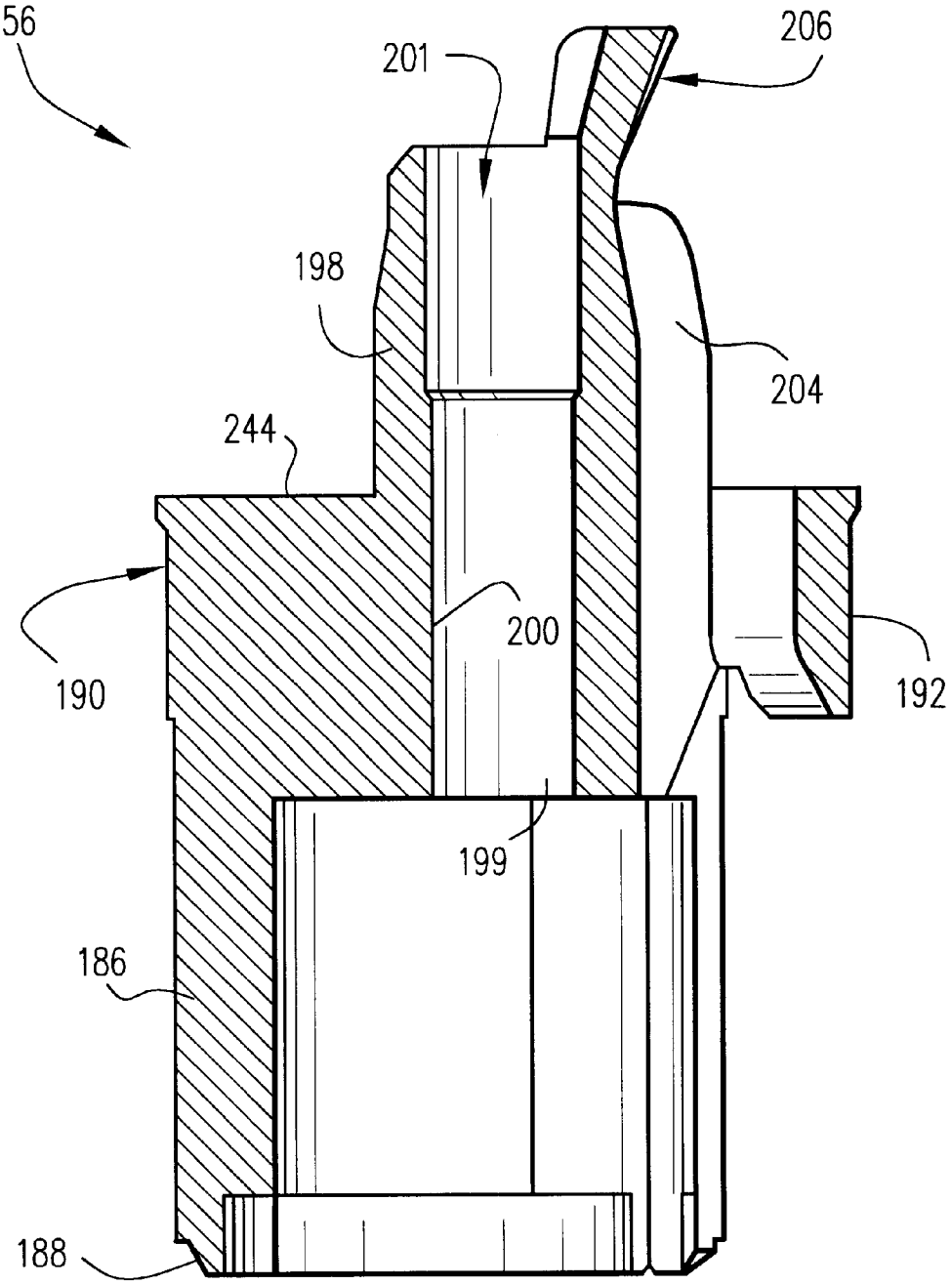
FIG. 17 is a section taken along the line 17—17 of FIG. 15.

A center hub 198 lies at the center of the stream deflector 156 and, for axial distances above and below the ring 190, the hub is cylindrical in shape, the lower portion being of substantially greater diameter (i.e., a relatively thick wall section) for strength so as to provide support for the shaft 20. The hub is formed with a bore 201 that receives the shaft 20 as best seen in FIGS. 2 and 3. The shaft 20 is press-fit within a slightly reduced diameter portion 200 of the bore 201, thus preventing water from leaking along the shaft, and preventing rotation of the shaft during normal operation. The reduced diameter portion 200 is shown in FIGS. 16 and 17 but is not apparent in the reduced scale of FIGS. 2 and 3.

Note that the shaft 20 and other internal components are protected in the event of external impacts. Specifically, impact forces acting on the rotor plate 18 will be transferred to the base 12 and, in turn, to the sprinkler system component to which the base is attached, especially when the rotor plate is in the retracted position, or if pushed down into the retracted position as a result of the impact. This is because the rotor plate 18 engages the arc adjustment ring along tapered surface 70, thus transferring the impact forces directly to the base 12 via surface 68.

The deflector is open between the ring 192 and hub 198 for approximately 195°. The maximum arc for this deflector (and associated nozzle) is 210°. The arcuate opening is bisected by a radial strengthening rib 202. Below the ring 190, the remaining approximately 150° of the tail end 186 is primarily intended as a flow restrictor for sprinklers with limited arcuate nozzle openings, thus reducing the sensitivity of the throttling action. As will be described below in connection with an alternative 3600 nozzle, the tail end 186 of the deflector may be omitted.

A vertical wall surface 204 of an upstanding vertical, radially extending tab 206 defines one end of the 210° arcuate opening. It is important that this wall surface 204 extend axially upstream from the discharge orifice at least as far as surface 244 and extend downstream to the downstream end of the deflecting surface 258 in order to smooth the water flow onto the rotor plate in a concentrated, non-turbulent manner. A second vertical wall surface 208 defines the other end of the arcuate opening. The tab 206 extends upwardly beyond the ring 190 axially along the hub 198 and interacts with the nozzle 26 to define the non-adjustable end of the adjustable arcuate discharge orifice. The other end 208 of the arcuate opening may be considered the adjustable end in that a wall of the nozzle 26 is movable toward and away from the tab 206 from end 208 to reduce the size of the length of the arc as described below.

Figure 14:
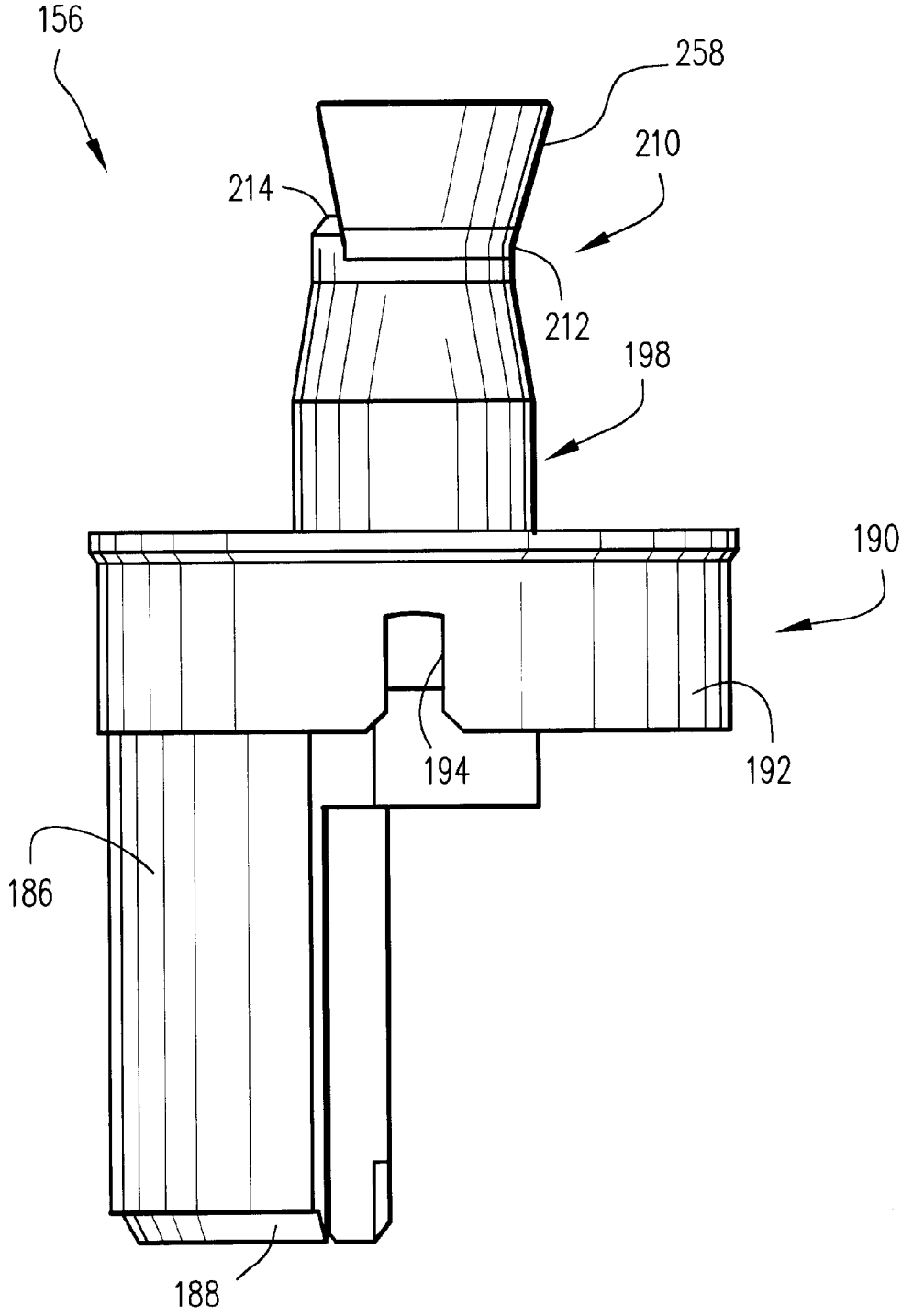
FIG. 14 is a side elevation of a stream deflector component incorporated in the sprinkler head shown in FIGS. 2 and 3.
Figure 15:
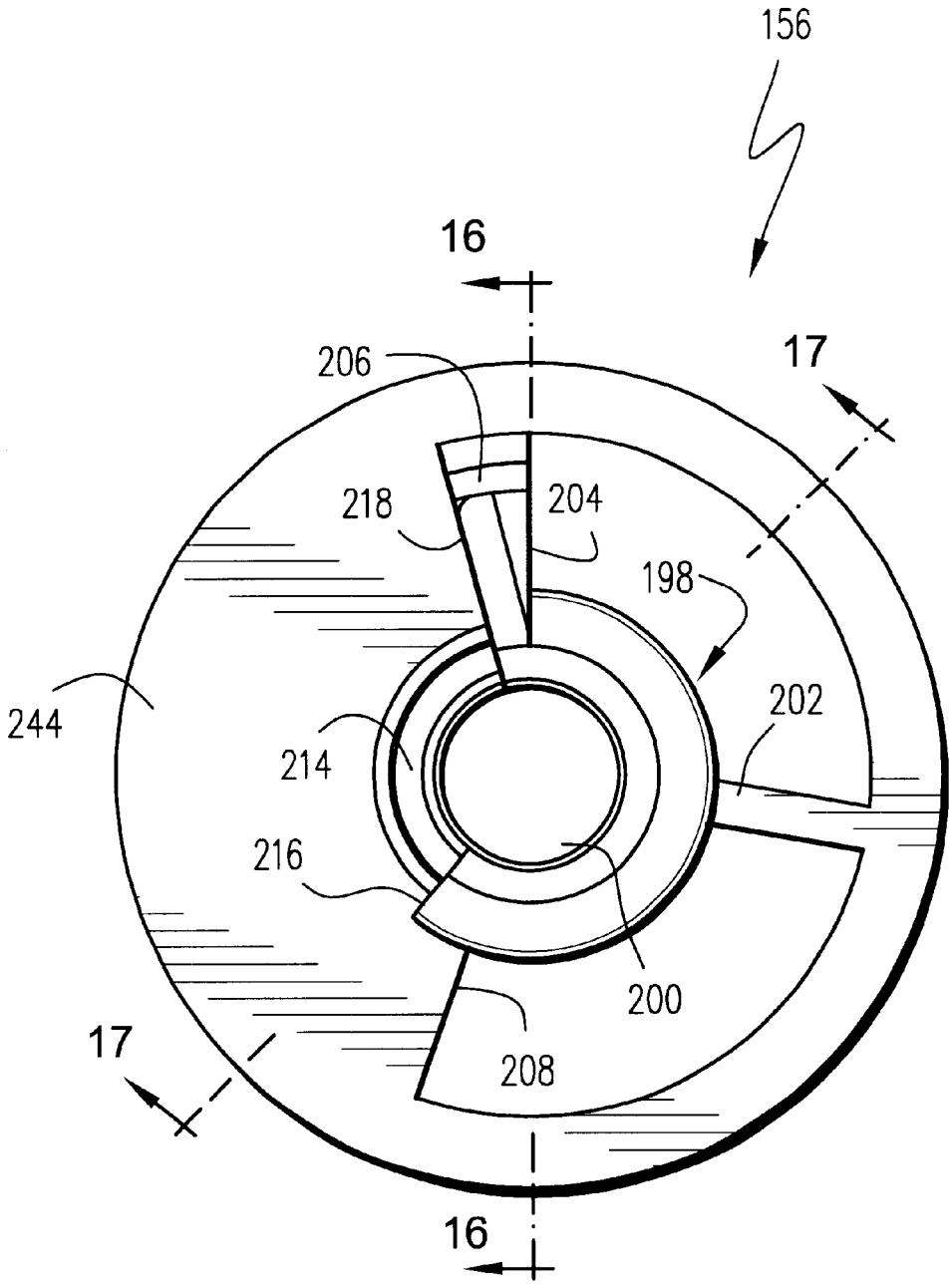
FIG. 15 is a plan view of the stream deflector component shown in FIG. 14.
Figure 18:
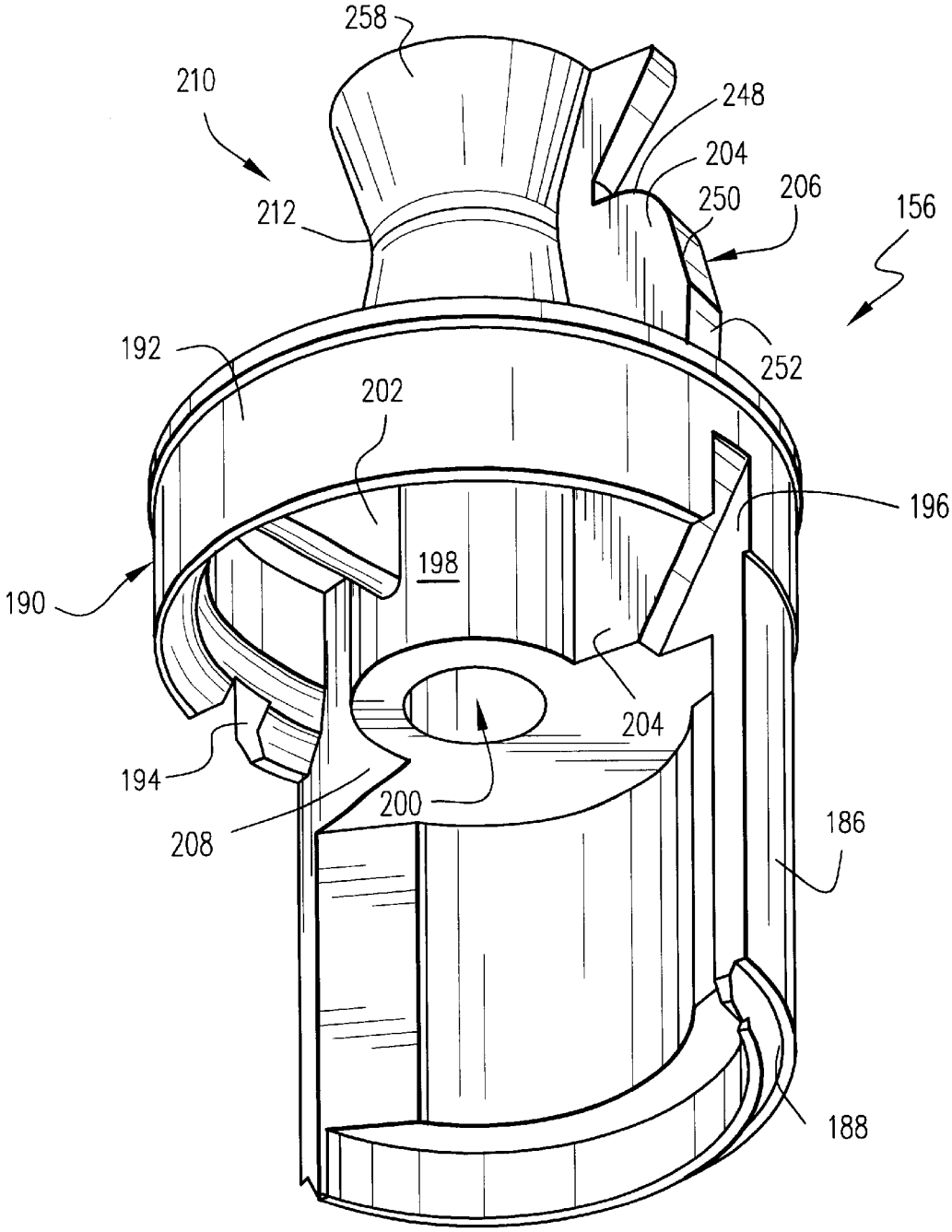
FIG. 18 is a perspective view of the stream deflector component.
Figure 19:
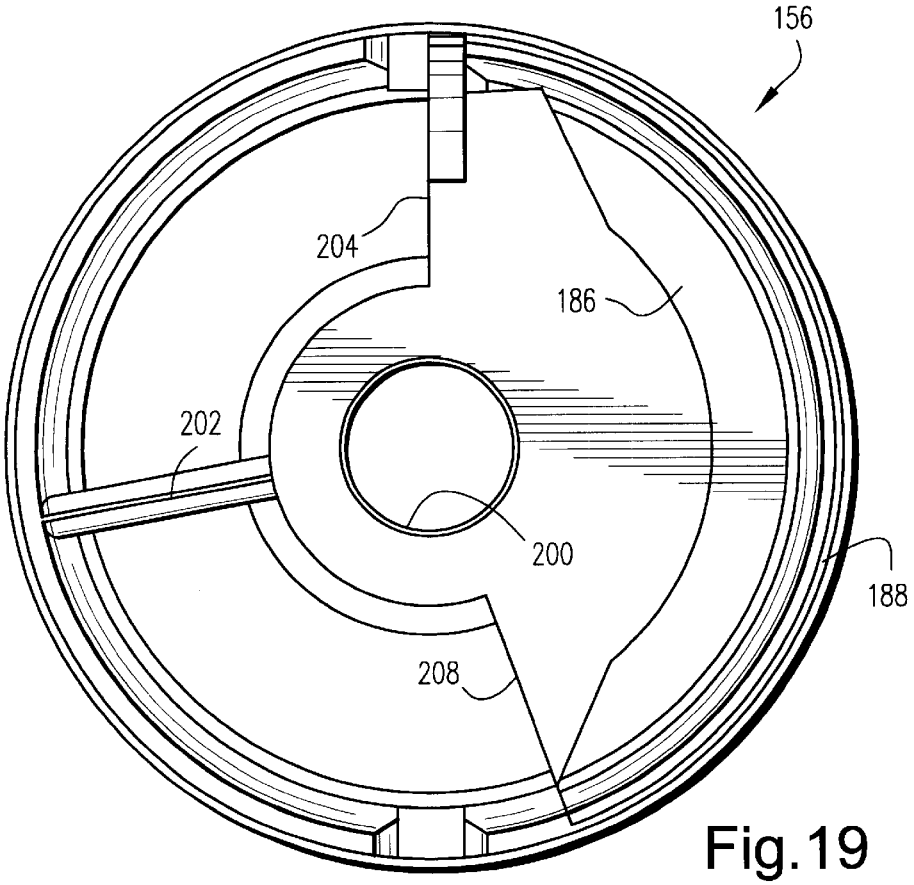
FIG. 19 is a bottom plan view of the stream deflector component.
Figure 20:
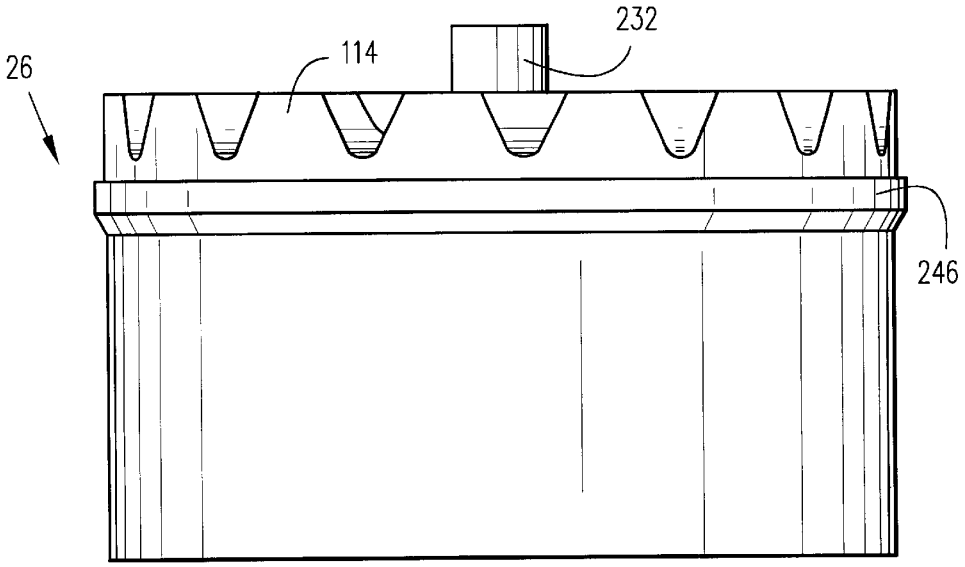
FIG. 20 is a side elevation of the nozzle component incorporated in the sprinkler head shown in FIGS. 2 and 3.
Figure 21:
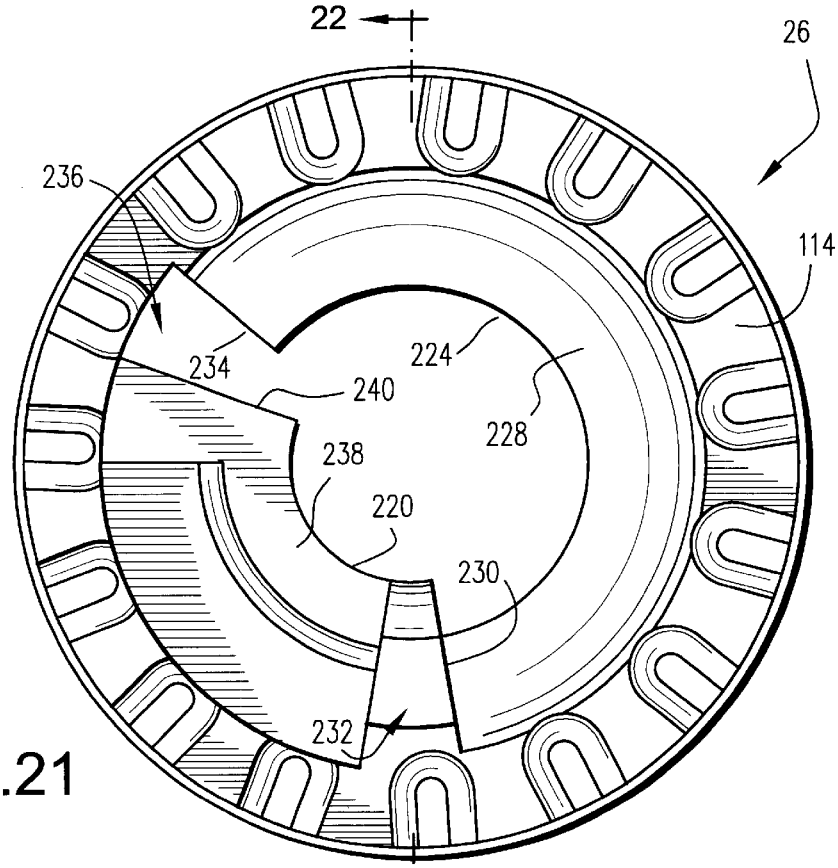
FIG. 21 is a top plan view of the nozzle component shown in FIG. 20.
Figure 22:
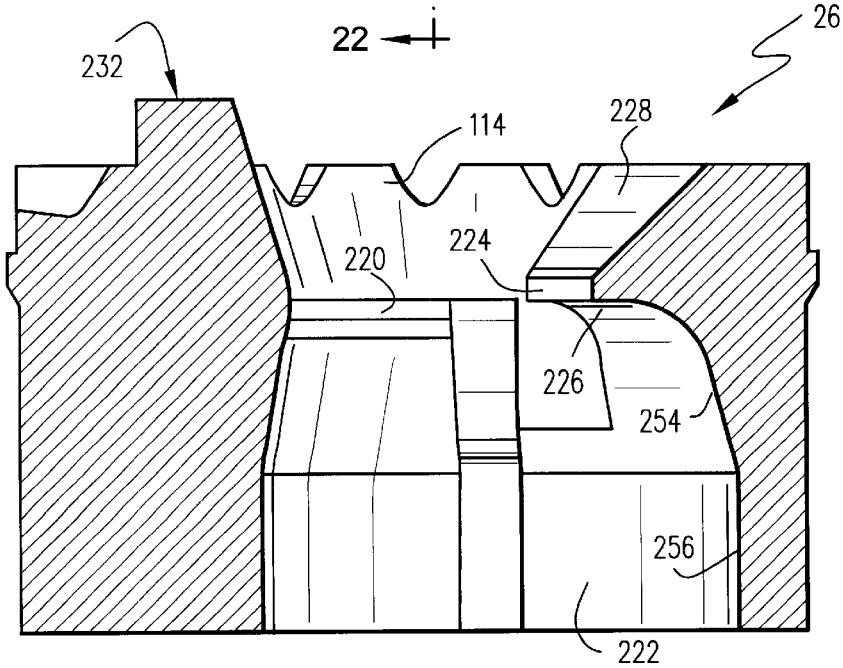
FIG. 22 is a section taken through line 22—22 of FIG. 21.
Figure 23:
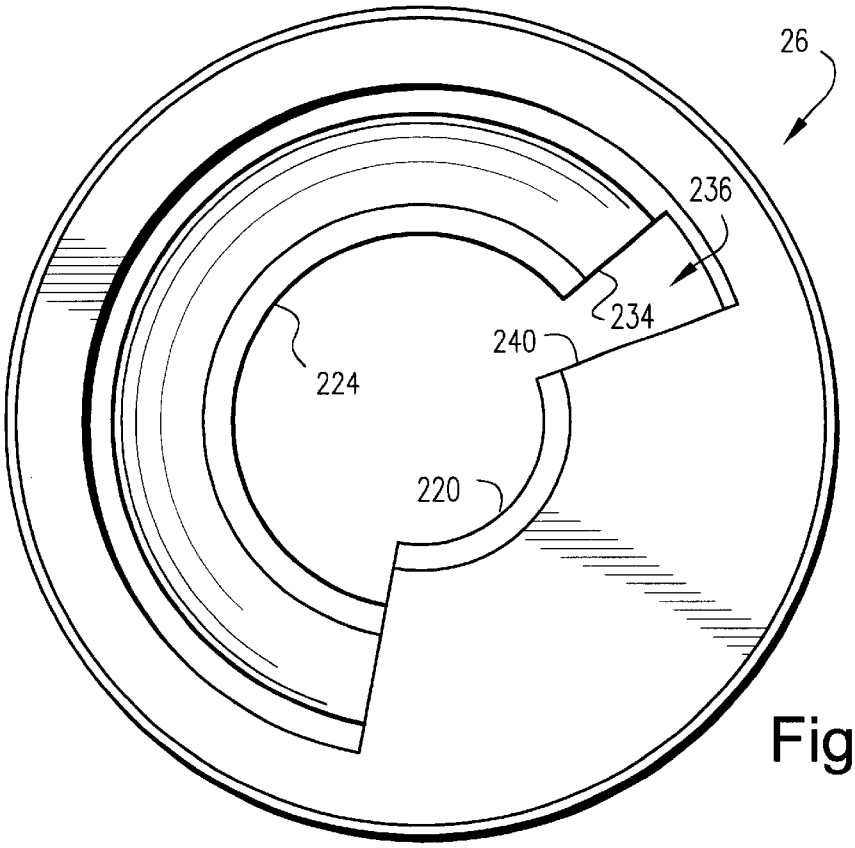
FIG. 23 is a bottom plan view of the nozzle component shown in FIG. 20.
Figure 24:
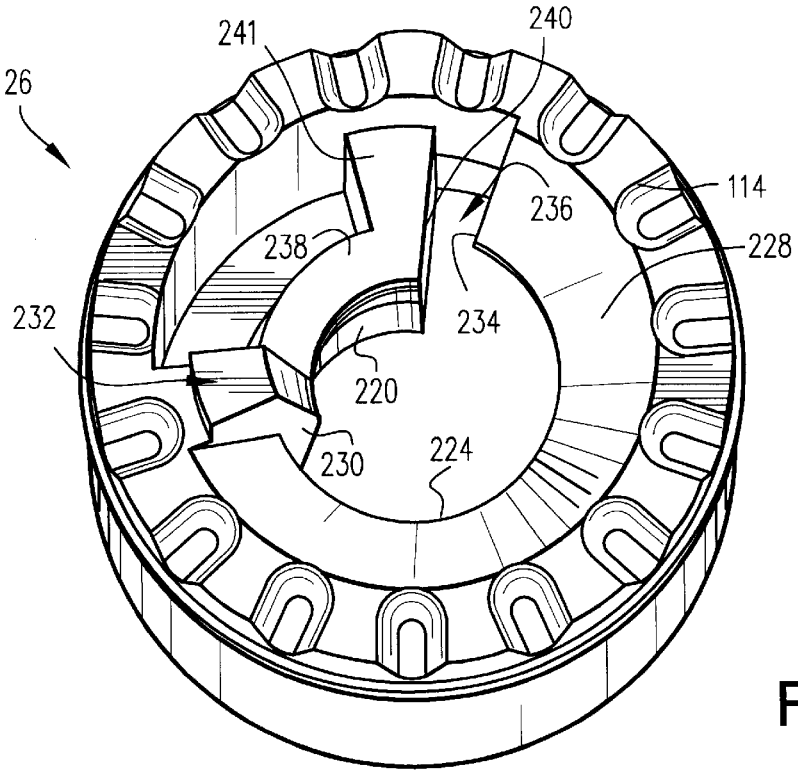
FIG. 24 is a perspective view of the nozzle component shown in FIG. 20.

With specific reference especially to FIGS. 14, 16 and 18, it may be seen that the hub 198 has a substantially hourglass shape 210 above the ring 190, the hourglass shape extending from one side of the tab 206 about the 195° arcuate opening and beyond the wall surface 208 (see FIG. 15). Thus, the hourglass shape is interrupted only at a location beyond the wall 208 and above the smallest diameter portion 212 of the hourglass part 210 of the deflector. This interrupted or cut-out area is defined by a part annular surface 214 extending from an edge 216 to the opposite wall surface 218 of the tab 206. As will be explained further below, the circumferential overlap of the wall 208 by the hourglass surface insures good sealing with cooperating surfaces of the nozzle 26. Before discussing the latter in detail, it should be noted that the radially innermost portion 212 of the hourglass surface defines the radially inner edge of the water discharge orifice formed with the nozzle. Placing this inner edge as close as possible to the central axis (or shaft 20) provides the largest possible radial opening for any given flow rate, thereby enabling passage of the largest possible contaminants without plugging the discharge orifice.

FIGS. 20–24 illustrate in greater detail the nozzle 26 that is supported on the stream deflector 156 (within the stem 14) for rotation relative to the stream deflector 156. The nozzle 26 is a generally cylindrical member with a centered, axial opening that the deflector 156 and the shaft 20 pass through, with an arcuate surface 220 engaged by the hub 198 of the deflector. The nozzle has an inlet end 222 and an outlet formed by an arcuate edge 224 with a rounded undercut 226 below the edge and a radially outwardly tapering surface 228 above the edge. Arcuate edge 224 is spaced radially outwardly of deflector surface 212 to thereby define the width of the arcuate discharge orifice 259. Circumferentially, the edge 224 extends approximately 250° from a first vertical surface 230 of an upstanding tab 232, to an edge 234 of a radial opening or notch 236. The radially inner axial contour of surface 230 substantially conforms to the hourglass-shaped portion of the stream deflector. Note that surface 220 that defines a radially inner surface of a partial hub 238 substantially completes the nozzle center opening, save the radial notch 236 that receives the vertical tab 206 of the deflector 156. The radial notch 236 is also defined by a radial wall surface 240 along a radial tab 241 of the hub 238. The nozzle shown is designed to cooperate with the deflector 156 to provide a nozzle orifice 259 of 90°–210°.

The upper annular edge of the nozzle is formed with a plurality of upwardly directed teeth 114 that mesh with the corresponding teeth 104 on the drive ring 92.

When the nozzle is in place as best seen in FIG. 3, and with the rotor plate 18, stem 14 and deflector 156 extended relative to the base 12, a gear drive is established between the arc adjustment ring 22 and the nozzle 26 by reason of the engagement of teeth 104 on the ring 92 with teeth 114 on the nozzle 26. Thus, rotation of ring 22 will rotate the nozzle 26, relative to the deflector 156 to alter the arcuate length of the water discharge orifice 259 as further described below.

When assembled as shown in FIG. 2, the nozzle 26 is seated on and seals against the surface 244 of the stream deflector 156, with an annular rib 246 on the nozzle engaging the interior wall of the stem 14 such that the nozzle can rotate relative to the deflector and the stem. Tab 206 extends upwardly through the radial notch 236 at assembly. Note that the interior surface of hub 238 of the nozzle conforms to the exterior surface of the deflector hub 198 preventing any leakage past surface 230 as the nozzle is rotatably adjusted relative to the deflector. Similarly, the radially outer edge surfaces 248, 250, 252 of the tab 206 (see FIGS. 16, 18) conform closely to undercut 226 and adjacent surfaces 254, 256 on the interior of the nozzle 26 to prevent leakage along the nozzle/deflector interface at the fixed end of the arcuate orifice 259. Rotation of the nozzle 26 relative to the deflector 156, causes nozzle surface 230 to move toward the fixed deflector surface 204, reducing the arcuate extent of the orifice. It is also important for surface 230 to extend axially upstream from the discharge orifice to the upstream end of the nozzle and downstream to the downstream end of the mating deflector surface 258 in order to smooth the water flow onto the rotor plate in a concentrated, non-turbulent manner. Note also that the axially extending cylindrical surface of the hub 198 of the stream deflector and the surfaces 256 and 254 of the nozzle interior also smooth the flow of water as it enters the nozzle orifice. Similarly, the deflecting surface 258 (the downstream end of the hourglass-shaped portion of the stem deflector) directs the flow downstream of the discharge orifice. It is this surface 258 that serves to deflect the stream emitted from the discharge orifice onto the grooves 24 of the rotor plate 18.

Figure 25:
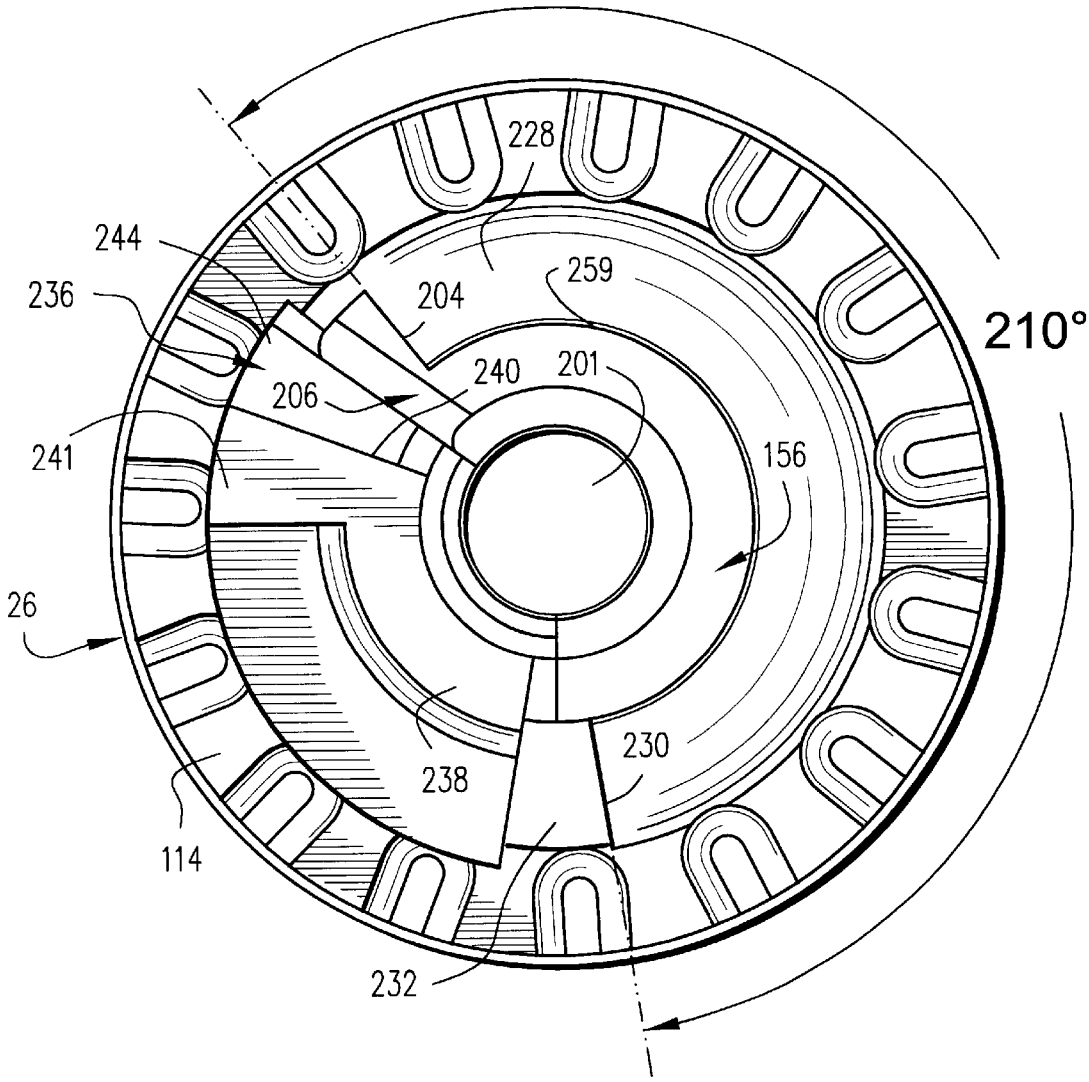
FIG. 25 is a top plan view of the deflector and nozzle arranged to provide a distribution arc of 210°.

FIG. 25 shows the nozzle 26 and stream deflector 156 in assembled position (all other components are omitted for clarity), with the nozzle 26 rotated slightly in a counterclockwise direction offsetting the radial notch 236 from the deflector tab 206 after insertion of the tab 206 through the notch 236 during assembly. This represents the maximum 210° arc for the orifice 259 as indicated in the Figure.

Figure 26:
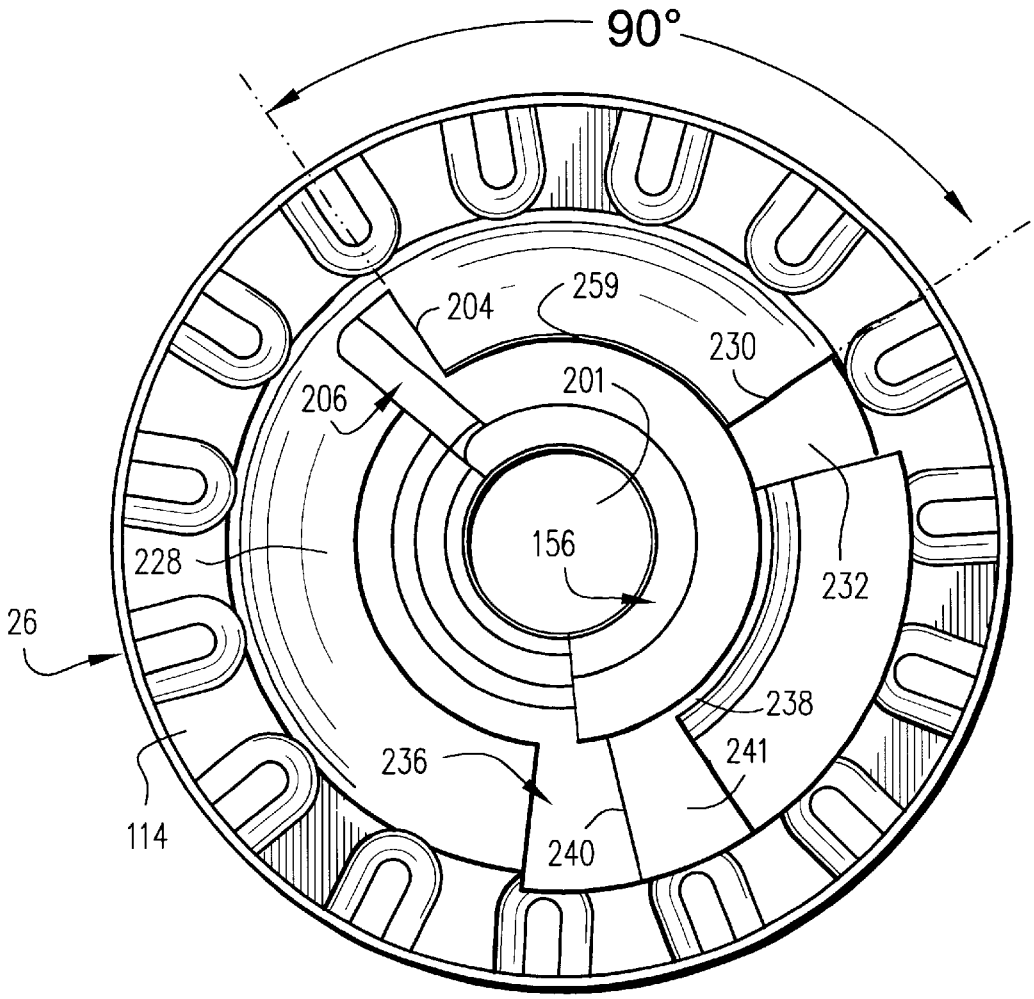
FIG. 26 is a top plan view of the deflector and nozzle as shown in FIG. 25 but adjusted to provide a distribution arc of 90°.

With further reference to FIG. 26, the nozzle 26 has been rotated further in a counterclockwise direction so that surface 230 moves toward fixed surface 204 to thereby reduce the arcuate length of the discharge orifice 259 from 210° to 90°. As explained previously, the nozzle can be rotated only when the teeth 88 on the arc adjustment ring 22 are engaged by the teeth 96 on the drive ring.

It is significant that the drive ring 92 is limited in its rotation by the vertical rib 116 that engages the edges of the two ribs 102 on the stem 14 at the arcuate limit of its travel in either direction. With reference to FIG. 9, the rib 116 on the actuator ring is located on the left of the centerline for a 90–210° head, and on the right of the centerline for a 210–270° head. Thus, for a 90°–210° configuration, the ring 22 can rotate only through the arc between adjacent edges of the pair of ribs 102 to the left of the centerline. This means that the edge 240 of the nozzle 26 cannot move beyond edge 208 of the stream deflector opening, as the result of over-rotation and thus preventing unwanted leakage of water through areas of the nozzle other than the arcuate discharge orifice.

With continuing reference to FIGS. 2 and 3 but also with reference to FIGS. 27 and 28, the sprinkler head 10 may be threadably secured to an extendable tube 260 of a conventional pop-up sprinkler device 262. The latter also includes a fixed riser or housing 264, adapted to be secured via a lower, threaded end 266 to a fitting or the like connected to a pipe that is, in turn, connected to a source of water under pressure.

The otherwise conventional pop-up mechanism 262 has an internal spring (not shown) that biases the extendable tube 260 to a retracted position where the sprinkler head 10 is essentially flush with the cap 268. When the system is turned on, the water pressure forces the tube 260 to the extended position shown in FIG. 27, against the bias of the internal spring.

As best seen in FIGS. 2 and 3, the coil spring 124 extends between the surface 122 of the stem 14 and surface 86 of the arc adjustment ring 22. Spring 124 thus exerts force on the subassembly of the stem 14, nozzle 26, deflector 156 and rotor plate 18 (the head subassembly) to bias the head subassembly to a retracted position within the base 12 as shown in FIGS. 2 and 27. In this position, a surface 19 of the rotor plate 18 engages along the surface 70 of the arc adjustment ring 22. As explained above, this arrangement, by which external forces acting on the rotor plate are transferred to the base and to the tube 260, protects the shaft 20 and other internal components. In addition, it will be appreciated that the small radial clearance between the outer diameter of the rotor plate (along a surface 21) and the axial surface 83 of the arc adjustment ring (see FIGS. 2 and 3) prevents foreign matter from lodging in this area, and that otherwise might fall into the nozzle area when the rotor plate is next extended to its operative position. Any foreign matter small enough to enter into the clearance area is also sufficiently small that it would not clog the discharge orifice 259. Note also in this regard that, as best seen in FIG. 2, the upper ends of grooves 24 in the rotor plate 18 are isolated from the engagement of the rotor plate with the arc adjustment ring.

After the pop-up tube 260 has extended as shown in FIG. 27, further pressure will cause the head subassembly to extend upwardly relative to the base 12 as shown in FIG. 28, thereby exposing the rotor plate 18 and permitting the radial distribution of the stream via grooves 24. This two-stage extension (and retraction) helps keep debris out of the area of spring 124 and around the upper end of the stem 14. Any sand or other small debris that may have migrated from the top of the rotor plate into the nozzle area is flushed from the head via the emitted stream. It is also significant that by locating spring 124 with opposite ends downstream of the nozzle 26, and radially outside of the stem 14 and nozzle 26, the spring substantially out of the flowpath of the water through the sprinkler head, thereby increasing the cross-sectional area available for water flow.

With the head subassembly extended as shown in FIG. 28, the arc adjustment drive between the nozzle 26, drive ring 92 and arc adjustment ring 22 is engaged, thus now also permitting the user to adjust the arc between 90° and 210°. Typically, the arc would be pre-set to the smallest length, i.e., 90°, with the throttle member 178 in its wide open position. Suitable indicator means may be employed so that the user can orient the sprinkler head 10 generally to face the area to be watered. This then also alerts the user to stand behind the arc so that further adjustments to the arc and flow rate can be made without getting wet. As the arc is increased from 90°, there will be a slight drop in the radius of throw, but the precipitation rate will remain substantially constant. The flow rate adjustment further controls the radius of throw so that individual sprinklers can be adjusted to match specific pattern areas, keeping the precipitation rate substantially constant.

For non radius adjustment applications, the sprinkler head could be constructed to omit the arc adjustment ring and to hold the nozzle stationary while rotating the shaft 20 and stream deflector 156 to achieve arc adjustment.

The deflector 156 and nozzle 26 shown in the drawings are for a 90–210° head. For a 210–270° head, it will be appreciated that the deflector and nozzle require appropriate modification to provide the larger discharge orifice.

Figure 29:
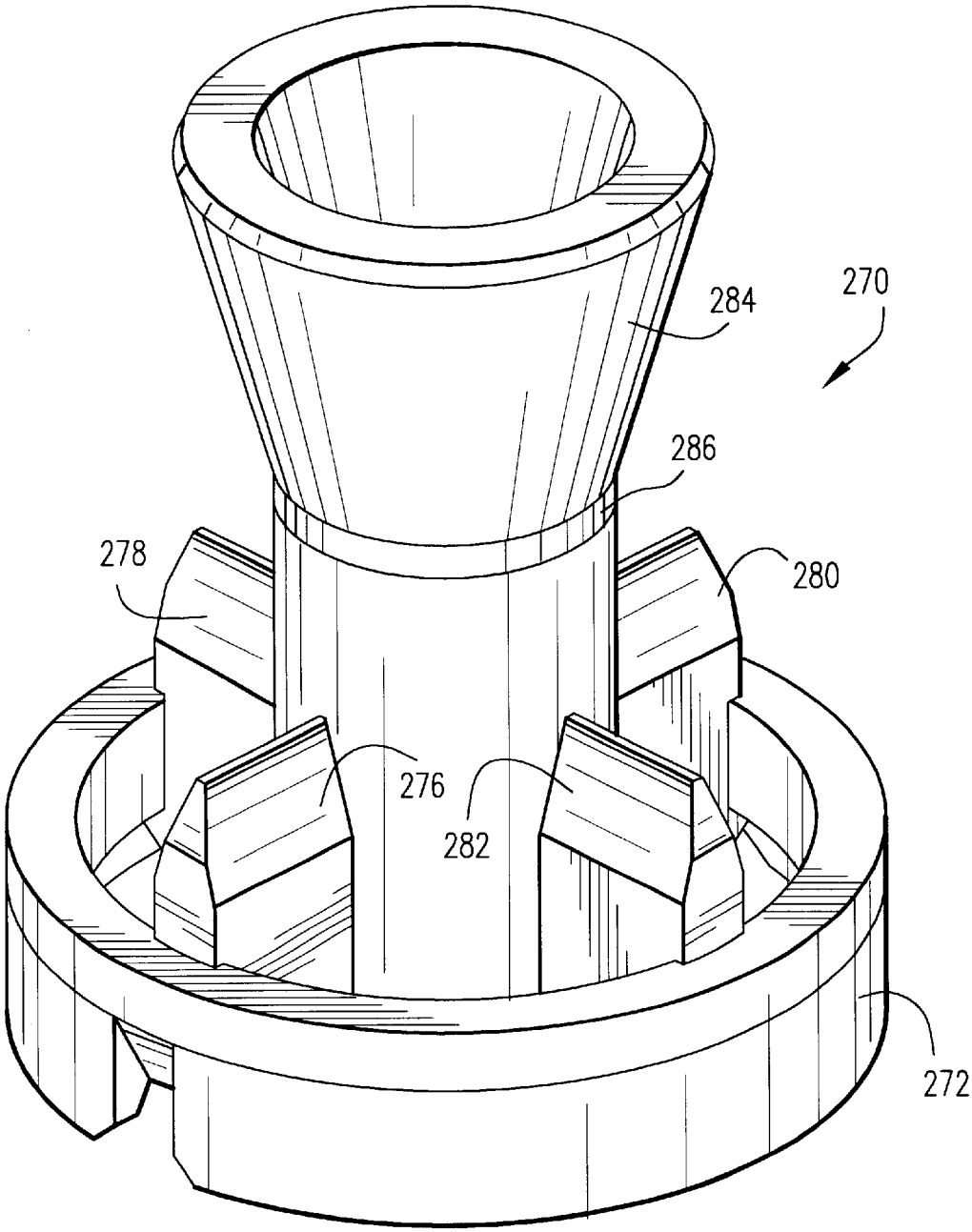
FIG. 29 is a perspective view of a stream deflector component in accordance with an alternative embodiment of the invention.
Figure 30:
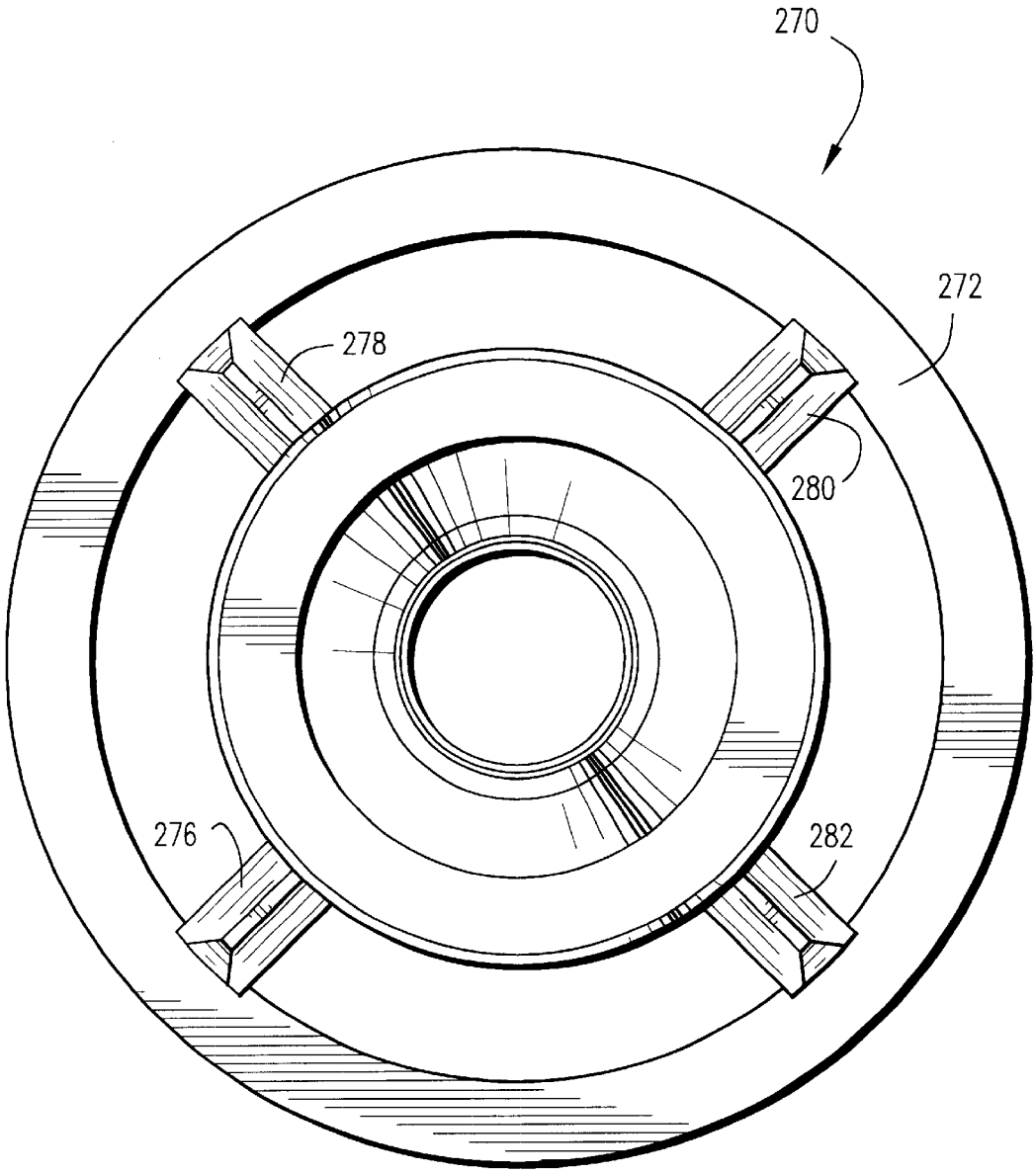
FIG. 30 is a top plan view of the stream deflector component shown in FIG. 29.
Figure 31:
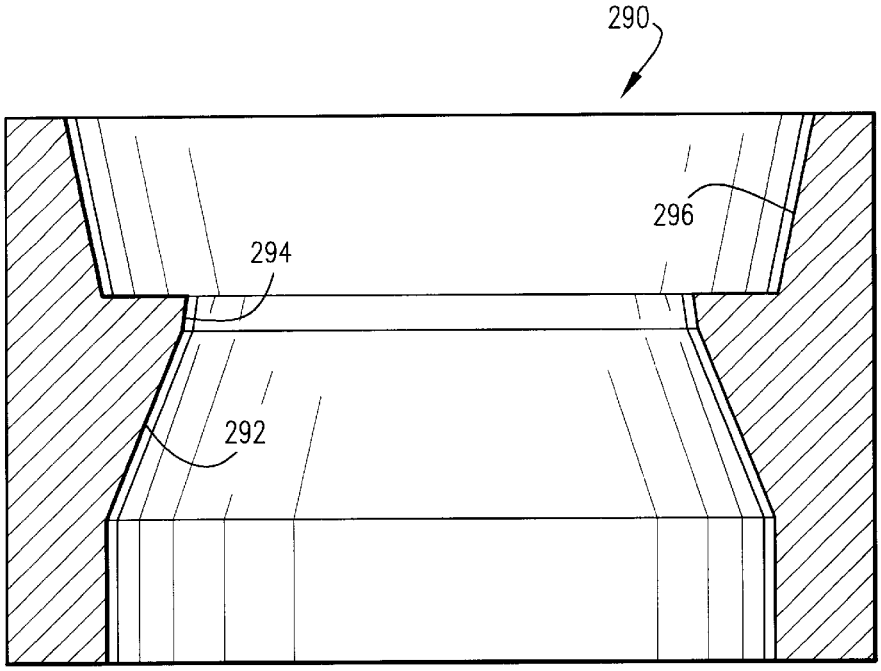
FIG. 31 is a side elevation of a nozzle in accordance with an alternative embodiment of the invention.

It is also possible in accordance with another embodiment of this invention to provide a 360° head, with adjustment of the flow rate, and hence throw radius adjustment, as previously described, but without any adjustment of the arc. With reference to FIGS. 29–31, a deflector and nozzle combination are illustrated for enabling a full 360° arc of coverage. The deflector 270 includes an outer ring 272 otherwise similar to ring 190 on deflector 156, but with the entire lower or tail end omitted. In addition, the opening between ring 272 and center hub 274 extends a full 360°, with connecting web or spokes 276, 278, 280 and 282 connecting the ring to the hub. No fixed arc edges are required, so that the deflecting surface 284 extends a full 360°, as does the radially inner edge surface 286 of the discharge orifice. The corresponding nozzle 290 is shown in FIG. 31. The nozzle includes a tapered inlet 292 and a smooth, 360° interior edge 294 that cooperates with surface 286 on the deflector to define the 3600 discharge orifice. A tapered surface 296 on the downstream side of the orifice corresponds to surface 228 on nozzle 26. With this arrangement, no arc adjustment is possible, but, of course, flow rate adjustment is available as described above.

It will be appreciated that the nozzle and stream deflector components could be modified to provide interchangeable, non-adjustable part circle arcs if the adjustability feature is otherwise not required.

Figure 32:
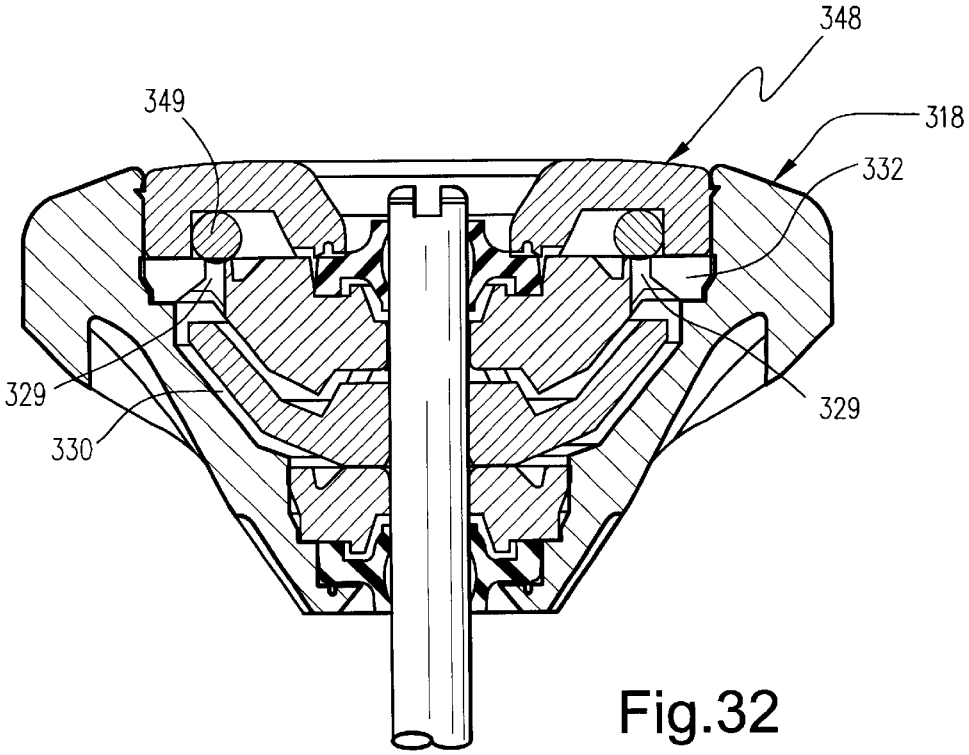
FIG. 32 is a cross section through a rotor plate in accordance with another exemplary embodiment of the invention.

FIG. 32 shows a modified rotor plate 318 that is similar to rotor plate 18, but the upper bearing 332 has been modified to include two (or more) axially oriented holes 329 that allow air to escape chamber 330 during assembly of the upper bearing, and move into the area between the bearing and the retainer 348. After the bearing is in place, an O-ring 349 is used to seal the holes 329 to prevent any viscous fluid from escaping the chamber 330.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler head comprising a base;

a nozzle and a stream deflector supported within the base, said nozzle and stream deflector cooperating to define an adjustable arcuate discharge orifice;

a water distribution plate supported on a shaft extending upwardly from said base, and adapted to be impinged by a stream emitted from the nozzle; and an arc adjustment ring rotatably mounted on said base, said arc adjustment ring operatively connectable with said nozzle for rotating said nozzle relative to said deflector for adjustment of said arcuate discharge orifice.

2. The sprinkler head of claim 1 wherein said base has a downstream end and an upstream end, said upstream end adapted for attachment to a pressurized water source.

3. The sprinkler head of claim 1 wherein said deflector and said nozzle are shaped to provide an arcuate discharge orifice adjustable between about 90° and about 210°.

4. The sprinkler head of claim 1 wherein said deflector and said nozzle are shaped to provide an arcuate discharge orifice adjustable between about 210° and about 270°.

5. The sprinkler head of claim 1 and further comprising a drive ring axially between said arc adjustment ring and said nozzle, with first cooperating drive elements between said arc adjustment ring and said drive ring, and second cooperating drive elements between said drive ring and said nozzle.

6. The sprinkler head of claim 5 wherein said first cooperating drive elements comprise meshing gear teeth.

7. The sprinkler head of claim 5 wherein said second cooperating drive elements comprise meshing gear teeth.

8. The sprinkler head of claim 6 wherein said second cooperating drive elements comprise meshing gear teeth.

9. The sprinkler head of claim 1 wherein said shaft is normally stationary and said water distribution plate rotates relative to said shaft.

10. The sprinkler head of claim 9 wherein said water distribution plate is mounted for rotation about said shaft and formed with an interior chamber defined by upper and lower bearings through which said shaft extends, and an interior surface of the water distribution plate; a stator fixed to the shaft and located within the chamber; and wherein said chamber is at least partially filled with a viscous fluid.

11. The sprinkler head of claim 10 including an upper seal mounted on said shaft above said upper bearing, and a lower seal mounted on said shaft below said lower bearing.

12. The sprinkler head of claim 11 including a retainer secured to said water distribution plate above said upper seal to thereby secure said upper bearing and upper seal to said rotor plate.

13. The sprinkler head of claim 1 wherein an elongated stem is supported within said base and said sprinkler component comprises a pop-up sprinkler assembly including a fixed housing and an extendable tube, said base located on said extendable tube; and wherein said stem, nozzle, deflector, shaft and water distribution plate are movable axially relative to said base from an inoperative retracted position where said water distribution plate is seated on said arc adjustment ring, to an operative extended position where said water distribution plate is axially spaced from said base.

14. The sprinkler head of claim 13 including a first coil spring radially outward of a stream emitted from the nozzle, said first coil spring having one end engaging a downstream end of said stem and an opposite end engaging said arc adjustment ring.

15. The sprinkler head of claim 14 wherein said first coil spring biases said water distribution plate toward said inoperative retracted position.

16. The sprinkler head of claim 13 wherein said arc adjustment ring is operatively connectable with said nozzle only when said water distribution plate is in said operative extended position.

17. The sprinkler head of claim 13 and further comprising a driving ring axially between said arc adjustment ring and said nozzle, with first cooperating drive elements between said arc adjustment ring and said drive ring, and second cooperating drive elements between said drive ring and said nozzle, said drive ring disengaged from said arc adjustment ring when said water distribution plate is in said inoperative retracted position.

18. The sprinkler head of claim 13 wherein in use, said extendable tube extends out of said fixed housing before said water distribution plate moves to said operative extended position.

19. The sprinkler head of claim 17 wherein said nozzle is engaged with said drive ring in both said inoperative retracted and operative extended positions.

20. The sprinkler head of claim 5 wherein said drive ring is provided with a rotation limiting rib on an exterior surface thereof.

21. A sprinkler head comprising a base;

an elongated stem supported within the base;

a nozzle and a stream deflector supported within the stem, said nozzle and stream deflector cooperating to define an arcuate orifice;

a water distribution plate supported on a shaft extending upwardly from said base, said water distribution plate located in axially spaced relationship to said nozzle and adapted to be impinged by a stream emitted from the nozzle; and an adjustment throttle member secured to an upstream end of said shaft such that rotation of said shaft causes said throttle member to move axially relative to a flow restriction portion, to thereby adjust flow rate through said nozzle and a throw radius of the stream emitted from said nozzle.

22. The sprinkler head of claim 21 wherein said base has a downstream end and an upstream end, said upstream end adapted for attachment to a pressurized water source.

23. The sprinkler head of claim 21 wherein said throttle member and said flow restriction portion are configured to always permit a predetermined minimum flow of water through said nozzle.

24. The sprinkler head of claim 23 wherein said predetermined minimum flow is sufficient to maintain rotation of said water distribution plate.

25. The sprinkler head of claim 21 wherein a distal end of said shaft projects from said water distribution plate to thereby allow a user to rotate said shaft to adjust said flow rate.

26. The sprinkler head of claim 25 wherein said distal end of said shaft is formed with a groove adapted to receive a tool for rotating said shaft.

27. The sprinkler head of claim 21 wherein said shaft is normally rotationally stationary and said water distribution plate rotates relative to said shaft.

28. The sprinkler head of claim 27 wherein said water distribution plate is formed with an interior chamber defined by upper and lower bearings through which said shaft extends, and an interior surface of the rotor plate; a stator fixed to the shaft and located within the chamber; and wherein said chamber is at least partially filled with a viscous fluid.

29. The sprinkler head of claim 28 including an upper seal mounted on said shaft above said upper bearing, and a lower seal mounted on said shaft below said lower bearing.

30. The sprinkler head of claim 29 including a retainer secured to said water distribution plate above said upper seal to thereby secure said upper bearing and upper seal.

31. The sprinkler head of claim 21 wherein said sprinkler component comprises a pop-up sprinkler assembly including a fixed housing and an extendable tube, said base located on an upper end of said extendable tube; and wherein said stem, nozzle, stream deflector, shaft and water distribution plate are movable axially relative to said base from an inoperative retracted position where said water distribution plate is seated on said base, to an operative extended position where said water distribution plate is axially spaced from said base.

32. The sprinkler head of claim 31 including a first coil spring radially outward of a stream emitted from the nozzle, wherein said coil spring biases said water distribution plate toward the inoperative position.

33. The sprinkler head assembly of claim 32 and wherein in use, said extendable tube extends out of said fixed housing before said water distribution plate moves to said operative extended position.

34. The sprinkler head of claim 21 wherein said throttle member and said stem are provided with cooperating guide elements for preventing rotation of said throttle member.

35. A sprinkler head comprising a base;

a nozzle and a stream deflector supported within the base, said nozzle and deflector cooperating to define an adjustable arcuate orifice;

a water distribution plate supported on a shaft extending upwardly from said base, said water distribution plate having a plurality of water distribution grooves therein located in axially spaced relationship to said nozzle and adapted to be impinged by a stream emitted from the nozzle;

an arc adjustment ring rotatably mounted on said base, said arc adjustment ring operatively connectable with said nozzle for rotating said nozzle relative to said steam for adjustment of said arcuate discharge orifice; and a throttle member secured to an upstream end of said shaft such that rotation of said shaft causes said throttle to move relative to a flow restriction portion, to thereby adjust flow rate through said nozzle and a throw radius of the stream emitted from the nozzle.

36. The sprinkler head of claim 35 wherein said base has a downstream end and an upstream end, said upstream end adapted for attachment to a pressurized water source.

37. The sprinkler head of claim 35 wherein said deflector and said nozzle are shaped to provide an arcuate discharge orifice adjustable between about 90° and about 210°.

38. The sprinkler head of claim 35 wherein said deflector and said nozzle are shaped to provide an arcuate discharge orifice adjustable between about 210° and about 270°.

39. The sprinkler head of claim 35 and further comprising a drive ring axially between said arc adjustment ring and said nozzle, with first cooperating drive elements between said arc adjustment ring and said drive ring, and second cooperating drive elements between said drive actuator ring and said nozzle.

40. The sprinkler head of claim 39 wherein said first cooperating drive elements comprise meshing gear teeth.

41. The sprinkler head of claim 39 wherein said second cooperating drive elements comprise meshing gear teeth.

42. The sprinkler head of claim 40 wherein said second cooperating drive elements comprise meshing gear teeth.

43. The sprinkler head of claim 35 wherein said shaft is normally stationary and said water distribution plate rotates relative to said shaft.

44. The sprinkler head of claim 43 wherein said water distribution plate is formed with an interior chamber defined by upper and lower bearings through which said shaft extends, and an interior surface of the water distribution plate; a stator fixed to the shaft and located within the chamber; and wherein said chamber is at least partially filled with a viscous fluid.

45. The sprinkler head of claim 44 including an upper seal mounted on said shaft above said upper bearing, and a lower seal mounted on said shaft below said lower bearing.

46. The sprinkler head of claim 45 including a retainer secured to said rotor plate above said upper seal to thereby secure said upper bearing and upper seal to said water distribution plate.

47. The sprinkler head of claim 35 wherein an elongated stem is supported within said base and said sprinkler component comprises a pop-up sprinkler assembly including a housing and an extendable tube, said base located on an upper end of said extendable tube; wherein said stem, nozzle, deflector, shaft and water distribution plate are movable axially relative to said base from an inoperative retracted position where said water distribution plate is seated on said base, to an operative extended position where said water distribution plate is axially spaced from said base.

48. The sprinkler head of claim 47 including a first coil spring radially outward of a stream emitted from the nozzle, said first coil spring having one end engaging a downstream end of said stem and an opposite end engaging said arc adjustment ring.

49. The sprinkler head of claim 48 wherein said first coil spring biases said water distribution plate toward said inoperative retracted position.

50. The sprinkler head of claim 47 and further comprising a drive ring axially between said arc adjustment ring and said nozzle, with first cooperating drive elements between said arc adjustment ring and said drive ring, and second cooperating drive elements between said drive actuator ring and said nozzle, said drive ring disengaged from said arc adjustment ring when said water distribution plate is in said inoperative, retracted position.

51. The sprinkler head of claim 47 wherein said arc adjustment ring is operatively connectable with said nozzle only when said water distribution plate is in said operative extended position.

52. The sprinkler head of claim 47 wherein, in use, said extendable tube extends out of said fixed housing before said rotor plate moves to said operative extended position.

53. The sprinkler head of claim 35 wherein said throttle member and said flow restriction portion are configured to always permit a predetermined minimum flow of water through said nozzle.

54. The sprinkler head of claim 53 wherein said predetermined minimum flow is sufficient to maintain rotation of said rotor plate.

55. The sprinkler head of claim 35 wherein a distal end of said shaft projects from said water distribution plate to thereby allow a user to rotate said shaft to adjust said flow rate and said throw radius.

56. The sprinkler head of claim 55 wherein said distal end of said shaft is formed with a groove adapted to receive a tool for rotating said shaft.

57. An adjustable arc sprinkler head comprising a substantially cylindrical housing; a stream deflector supported in said housing; a nozzle located on said stream deflector and rotatable relative thereto, said nozzle having a first arcuate edge; wherein said stream deflector has a substantially hourglass shaped portion, tapering inwardly upstream of said first arcuate edge and tapering outwardly downstream of said first arcuate edge, thereby establishing a second arcuate edge radially inwardly spaced from said first arcuate edge and defined by a smallest diameter of said hourglass shaped portion; said first and second arcuate edges defining an adjustable discharge orifice having an arcuate length, a downstream end of said stream deflector having a radially extending vertical tab with a first vertical surface forming one end of said adjustable discharge orifice, and a second vertical surface on said nozzle forming a second end of said adjustable discharge orifice, said first and second ends movable relatively toward and away from each other to thereby vary said arcuate length of said discharge orifice.

58. The adjustable arc sprinkler head of claim 57 wherein said arcuate discharge orifice is adjustable between about 90° and about 210°.

59. The adjustable arc sprinkler head of claim 57 wherein said arcuate discharge orifice is adjustable between about 210° and about 270°.

60. The adjustable arc sprinkler head of claim 57 wherein said nozzle is formed with a radial notch adjacent one end of said arcuate edge, and wherein said vertical tab extends through said notch.

61. The adjustable arc sprinkler head of claim 57 wherein said second vertical surface has an edge contour that substantially conforms to said hourglass-shaped portion of said stream deflector.

62. The adjustable arc sprinkler head of claim 57 wherein said nozzle is operatively connectable to an arc adjustment ring mounted on an upper edge of said housing.

63. The adjustable arc sprinkler head of claim 62 wherein said housing is threadably secured to an extendable tube of a pop-up sprinkler.

64. The adjustable arc sprinkler head of claim 57 and further comprising a water distribution plate located above said nozzle.

65. A pop-up sprinkler assembly comprising a first tubular member having an inlet end adapted for connection to a source of water under pressure;

a second tubular member slidably mounted within said first tubular member and including a sprinkler head;

a first coil spring located within said first tubular member arranged to bias said second tubular member to a retracted position within said first tubular member, said second tubular member movable to an extended position when water under pressure is admitted to said inlet end;

said sprinkler head including an elongated stem;

a nozzle supported on said stem;

a water distribution plate mounted on a shaft projecting upwardly through said nozzle, said nozzle and said water distribution plate extendable relative to said second tubular member to an operative position;

a second coil spring located in said sprinkler head, radially outwardly of said nozzle, supported at one end by a downstream end of said stem, and arranged to bias said water distribution plate to an inoperative position relative to said second tubular member.

66. A pop-up sprinkler assembly of claim 65 wherein said second tubular member moves toward said extended position before said water distribution plate and nozzle move toward said operative position.

67. The pop-up sprinkler of claim 66 wherein said sprinkler head further comprises a stream deflector supported within said stem, said nozzle and stream deflector cooperating to define an adjustable, arcuate discharge orifice; and an arc adjustment ring operatively connectable with said nozzle for rotating said nozzle relative to said stream deflector for adjustment of said arcuate orifice.

68. The pop-up sprinkler of claim 67 wherein said second coil spring is supported at an opposite end thereof by said arc adjustment ring.

69. The pop-up sprinkler assembly of claim 67 wherein said stream deflector and said nozzle are shaped to provide an arcuate orifice adjustable between about 90° and about 210°.

70. The pop-up sprinkler assembly of claim 67 wherein said stream deflector and said nozzle are shaped to provide an arcuate orifice adjustable between about 210° and about 270°.

71. The pop-up sprinkler assembly of claim 67 and further comprising a drive ring axially between said arc adjustment ring and said nozzle, with first cooperating drive elements between said arc adjustment ring and said drive ring, and second cooperating drive elements between said drive ring and said nozzle.

72. The pop-up sprinkler assembly of claim 71 wherein said first cooperating drive elements comprise meshing gear teeth.

73. The pop-up sprinkler assembly of claim 71 wherein said second cooperating drive elements comprise meshing gear teeth.

74. The pop-up sprinkler assembly of claim 72 wherein said second cooperating drive elements comprise meshing gear teeth.

75. The pop-up sprinkler assembly of claim 67 wherein said shaft is normally stationary and said water distribution plate rotates relative to said shaft.

76. The pop-up sprinkler assembly of claim 75 wherein said water distribution plate is provided with a plurality of grooves aligned with said nozzle for radially distributing a stream emitted from said nozzle; and further wherein said water distribution plate is formed with an interior chamber defined by upper and lower bearings through which said shaft extends, and an interior surface of the water distribution plate; a stator fixed to the shaft and located within the chamber; and wherein said chamber is at least partially filled with a viscous fluid.

77. The pop-up sprinkler assembly of claim 76 including an upper seal mounted on said shaft above said upper bearing, and a lower seal mounted on said shaft below said lower bearing.

78. The pop-up sprinkler assembly of claim 77 including a retainer secured to said water distribution plate above said upper seal to thereby secure said upper bearing and upper seal to said water distribution plate.

79. The pop-up sprinkler assembly of claim 67 wherein said arc adjustment ring is operatively connectable with said nozzle only when said water distribution plate is in said operative position.

80. The pop-up sprinkler assembly of claim 65 and further comprising a flow rate adjustment throttle member secured to an upstream end of said shaft such that rotation of said shaft causes said throttle member to move relative to a flow restriction portion, to thereby adjust flow rate through said nozzle and a throw radius of the stream emitted from said nozzle.

81. The pop-up sprinkler assembly of claim 80 wherein said throttle member and said flow restriction portion are configured to always permit a predetermined minimum flow of water through said flow restriction portion.

82. The pop-up sprinkler assembly of claim 81 wherein said predetermined minimum flow is sufficient to maintain rotation of said water distribution plate.

83. The pop-up sprinkler assembly of claim 80 wherein a distal end of said shaft projects from said water distribution plate to allow access for rotation of said shaft to adjust said flow rate.

84. The pop-up sprinkler assembly of claim 83 wherein said distal end of said shaft is formed with a groove adapted to receive a tool for rotating said shaft.

85. A pop-up sprinkler assembly comprising a first tubular member having an inlet end adapted for connection to a pressurized water source;

a second tubular member slidably mounted within said first tubular member for movement between retracted and extended positions;

a first coil spring located within said first tubular member arranged to bias said second tubular member toward said retracted position within said first tubular member, said second tubular member movable to said extended position when water under pressure is admitted to said inlet end;

a sprinkler head including a tubular base at an upper end of said second tubular member;

an elongated stem supported within the base;

a rotatable nozzle and a stream deflector supported within the stem, said nozzle and stream deflector cooperating to define an adjustable arcuate discharge orifice;

a rotor plate supported on a shaft extending from said stem, said rotor plate having a plurality of water distribution grooves therein located in axially spaced relationship to said nozzle and adapted to be impinged by a stream issuing from the nozzle;

an arc adjustment ring rotatably mounted on said base, said arc adjustment ring operatively connectable with said nozzle for rotating said nozzle relative to said stem for adjustment of said arcuate orifice; and a second coil spring radially outward of said nozzle and extending between a downstream end of said stem and said arc adjustment ring to thereby bias said rotor plate toward an inoperative position within said base, and movable to an operative position axially spaced from said base when water under pressure is admitted to said inlet end; and a throttle member secured to an upstream end of said shaft such that rotation of said shaft causes said throttle to move relative to a flow restriction portion of said stem, to thereby adjust flow rate through said nozzle and a throw radius of the stream emitted from said nozzle.

86. The pop-up sprinkler assembly of claim 85 wherein, in use, said second tubular member moves to said extended position before said rotor plate moves to said operative position.

87. The pop-up sprinkler assembly of claim 85 wherein said rotor plate and said arc adjustment ring cooperate to substantially block foreign matter from entering said tubular base when said rotor plate is in said retracted position.

88. The pop-up sprinkler assembly of claim 85 wherein said stream deflector and said nozzle are shaped to provide an arcuate discharge orifice adjustable between about 90° and about 210°.

89. The pop-up sprinkler assembly of claim 85 wherein said stream deflector and said nozzle are shaped to provide an arcuate orifice adjustable between about 210° and about 270°.

90. The pop-up sprinkler assembly of claim 85 and further comprising a drive ring axially between said arc adjustment ring and said nozzle, with first cooperating drive elements between said arc adjustment ring and said drive ring, and second cooperating drive elements between said drive actuator ring and said nozzle.

91. The pop-up sprinkler assembly of claim 90 wherein said first cooperating drive elements comprise meshing gear teeth.

92. The pop-up sprinkler assembly of claim 90 wherein said second cooperating drive elements comprise meshing gear teeth.

93. The pop-up sprinkler assembly of claim 91 wherein said second cooperating drive elements comprise meshing gear teeth.

94. The pop-up sprinkler assembly of claim 85 wherein said shaft is normally stationary and said rotor plate rotates relative to said shaft.

95. The pop-up sprinkler assembly of claim 94 wherein said rotor plate is formed with an interior chamber defined by upper and lower bearings through which said shaft extends, and an interior surface of the rotor plate; a stator fixed to the shaft and located within the chamber; and wherein said chamber is at least partially filled with a viscous fluid.

96. The pop-up sprinkler assembly of claim 95 including an upper seal mounted on said shaft above said upper bearing, and a lower seal mounted on said shaft below said lower bearing.

97. The pop-up sprinkler assembly of claim 96 including a retainer secured to said rotor plate above said upper seal to thereby secure said upper bearing and upper seal to said rotor plate.

98. The pop-up sprinkler assembly of claim 85 wherein said arc adjustment ring is operatively connectable with said nozzle only when said rotor plate is in said operative position.

99. The pop-up sprinkler assembly of claim 85 wherein said throttle member and said portion of said stem are configured to always permit a predetermined minimum flow of water through said valve.

100. The pop-up sprinkler assembly of claim 99 wherein said predetermined minimum flow is sufficient to maintain rotation of said rotor plate.

101. The pop-up sprinkler assembly of claim 85 wherein a distal end of said shaft projects from said rotor plate to allow a user to access to said shaft for adjustment of said flow rate.

102. The pop-up sprinkler assembly of claim 101 wherein said distal end of said shaft is formed with a groove adapted to receive a tool for rotating said shaft.

103. A sprinkler head comprising a base having an upper end and a lower end, said lower end adapted for attachment to a sprinkler component;

an elongated stem supported within the base and movable between retracted and extended positions;

a nozzle and a stream deflector supported within the stem, said nozzle and deflector cooperating to define an arcuate discharge orifice adjustable through a predetermined arc; and an arc adjustment ring rotatably mounted on said base, said arc adjustment ring operatively connectable with said nozzle for rotating said nozzle relative to said stream deflector for adjustment of said arcuate discharge orifice; and wherein said arc adjustment ring is operatively connectable with said nozzle only when said stem is in said operative extended position.

104. The sprinkler head of claim 103 including means for preventing over-rotation of said arc adjustment ring.

105. The sprinkler head of claim 103 including means for adjusting flow rate through the nozzle.

106. The sprinkler head of claim 103 including a rotor plate supported on a shaft extending upwardly from said stem, said rotor plate having a plurality of water distribution grooves therein located in axially spaced relationship to said nozzle and adapted to be impinged by a stream emitted from the nozzle.

107. A sprinkler head comprising a base; a nozzle supported within the base; a water distribution plate supported above the nozzle for movement toward and away from the base between respective inoperative and operative positions, said nozzle having an orifice arranged to direct water emitted therefrom onto said water distribution plate; and at least one spring, opposite ends of which are located downstream and radially outward of said nozzle in both the inoperative and operative positions so as to be substantially outside a flow path for water flowing through the sprinkler head, said spring arranged to bias said water distribution plate toward said base.

108. A sprinkler head comprising a base;

a nozzle and a stream deflector supported within the base, said nozzle and stream deflector cooperating to define an adjustable arcuate discharge orifice;

a water distribution plate supported on a shaft extending upwardly from said base, and adapted to be impinged by a stream emitted from the nozzle; and means for effecting relative movement between said nozzle and said stream deflector for adjusting an arcuate length of said discharge orifice.

* * * * *

UNITED STATES PATENT AND TRADEMARK OFFICE

CERTIFICATE OF CORRECTION

PATENT NO. : 6,651,905 B2 
APPLICATION NO. : 09/818275
DATED : November 25, 2003
INVENTOR(S) : Sesser et al.

It is certified that error appears in the above-identified patent and that said Letters Patent is hereby corrected as shown below:

The title page should be deleted to appear as per attached title page.
The sheet of drawing consisting of figure 1 should be deleted to appear as per attached sheet.

Title page of Patent No. 6,651,905 at INID code (56), reference 30 of the References Cited, delete "Seser" and insert --Sesser--.

Title page of Patent No. 6,651,905 at INID code (57), line 1 of the Abstract, delete "and" and insert --end--.

Title page of Patent No. 6,651,905 at INID code (57), line 3 of the Abstract, delete "steam" and insert --stem--.

Column 7, line 18, delete "arc" and insert --are--.

Column 7, line 47, delete "32" and insert --38--.

Column 9, line 25, before "provides" insert --, in combination with tubular portion 132 forms a groove 155 that--.

Column 9, line 25, after "seat" delete "155".

Column 9, line 33, delete "surfaces" and insert --surface--.

Column 10, line 57, delete "3600" and insert --360°--.

Column 11, line 5, after "end" insert --(or wall)--.

Column 11, line 13, insert --end or-- between "the" and "wall", and delete "surface".

Column 14, line 20, delete "3600" and insert --360°--.

Column 22, line 14, delete "to" (second occurrence).

See the attached sheets of replacement drawings including reference number corrections and/or additions to Figures 1, 2, 3, 14, 16, 18, 29 and 32 as follows:

Figure 1 – Reference numeral 90 added
Figure 2 – Reference numerals 25, 86 and 122 added
Figure 3 – Reference numerals 86 and 122 added
Figure 14 – Location of reference numeral 212 corrected
Figure 16 – Location of reference numeral 212 corrected

UNITED STATES PATENT AND TRADEMARK OFFICE

CERTIFICATE OF CORRECTION

PATENT NO. : 6,651,905 B2
APPLICATION NO. : 09/818275
DATED : November 25, 2003
INVENTOR(S) : Sesser et al.

It is certified that error appears in the above-identified patent and that said Letters Patent is hereby corrected as shown below:

Figure 18 – Location of reference numeral 212 corrected
Figure 29 – Reference numeral 274 added
Figure 32 – Hatch direction corrected and hatching added Signed and Sealed this Third Day of October, 2006

JON W. DUDAS
*Director of the United States Patent and Trademark Office*

(12) United States Patent
Sesser et al.

(10) Patent No.: US 6,651,905 B2
(45) Date of Patent: Nov. 25, 2003

(54) ADJUSTABLE ARC, ADJUSTABLE FLOW RATE SPRINKLER

(75) Inventors: George Sesser, Walla Walla, WA (US); Lee A. Perkins, Lowden, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 09/818,275

(22) Filed: Mar. 28, 2001

(65) Prior Publication Data

US 2002/0139868 A1 Oct. 3, 2002

(51) Int. Cl.[7] ..... B05B 15/10

(52) U.S. Cl. ..... 239/205; 239/222.17; 239/231; 239/247; 239/252; 239/456; 239/511; 239/580

(58) Field of Search ..... 239/203–206, 239/222.11–222.21, 231–233, 243–247, 252, 451–460, 511–514, DIG. 1, 579, 580, 581.1–581.2, 582.1

(56) References Cited

U.S. PATENT DOCUMENTS

| | | | | | |
|---|---|---|---|---|---|
| 3,131,867 | A | | 5/1964 | Miller et al. | |
| 3,583,638 | A | * | 6/1971 | Eby | 239/230 |
| 3,771,723 | A | * | 11/1973 | Ray | 239/230 |
| 3,884,416 | A | | 5/1975 | King | |
| 3,940,066 | A | | 2/1976 | Hunter | |
| 4,091,997 | A | * | 5/1978 | Ridgway | 239/206 |
| 4,119,275 | A | | 10/1978 | Hunter | |
| 4,154,404 | A | | 5/1979 | Clawson | |
| 4,261,515 | A | | 4/1981 | Rosenberg et al. | |
| 4,579,285 | A | | 4/1986 | Hunter | |
| RE32,386 | E | | 3/1987 | Hunter | |
| 4,687,139 | A | * | 8/1987 | Lockwood | 239/206 |
| 4,753,391 | A | * | 6/1988 | Rogers | 239/203 |
| 4,796,809 | A | | 1/1989 | Hunter | |
| 4,815,662 | A | | 3/1989 | Hunter | |
| 4,842,201 | A | | 6/1989 | Hunter | |
| 4,850,532 | A | | 7/1989 | Mackanos | |
| 4,867,379 | A | | 9/1989 | Hunter | |
| 4,898,332 | A | | 2/1990 | Hunter et al. | |
| 4,932,590 | A | | 6/1990 | Hunter | |
| 4,944,456 | A | | 7/1990 | Zakai | |
| 4,967,961 | A | | 11/1990 | Hunter | |
| 4,971,250 | A | | 11/1990 | Hunter | |
| 4,986,474 | A | | 1/1991 | Schisler et al. | |
| 5,031,840 | A | | 7/1991 | Grundy et al. | |
| 5,058,806 | A | * | 10/1991 | Rupar | 239/205 |
| RE33,823 | E | | 2/1992 | Nelson et al. | |
| 5,148,990 | A | | 9/1992 | Kah, Jr. | |
| 5,226,602 | A | | 7/1993 | Cochran et al. | |
| 5,288,022 | A | * | 2/1994 | Seser | 239/206 |
| 5,288,023 | A | | 2/1994 | Han et al. | |
| 5,360,167 | A | | 11/1994 | Grundy et al. | |
| 5,556,036 | A | | 9/1996 | Chase | |
| 5,647,541 | A | | 7/1997 | Nelson | |
| 5,718,381 | A | * | 2/1998 | Katzer et al. | 239/222.11 |
| 5,762,270 | A | | 6/1998 | Kearby et al. | |
| 5,823,440 | A | | 10/1998 | Clark | |
| 5,927,607 | A | | 7/1999 | Scott | |

* cited by examiner

*Primary Examiner*—Michael Mar
*Assistant Examiner*—Dinh Q. Nguyen
(74) *Attorney, Agent, or Firm*—Nixon & Vanderhye P.C.

(57) ABSTRACT

A sprinkler head includes a base having a lower and adapted for attachment to a sprinkler system component; an elongated steam supported within the base; a nozzle and a fixed deflector supported within the stem, the nozzle and deflector cooperating to define an adjustable arcuate orifice. A water distribution plate is supported on a shaft extending upwardly from the stem and has a plurality of water distribution grooves located in axially spaced relationship to the nozzle. An arc adjustment ring is rotatably mounted on the base and is operatively connectable with the nozzle for rotating the nozzle relative to the stem for adjustment of the arcuate discharge orifice. A throttle member is secured to the upstream end of the shaft such that rotation of the shaft causes the throttle to move relative to a portion of the stem, to thereby adjust flow rate through the nozzle.

108 Claims, 24 Drawing Sheets

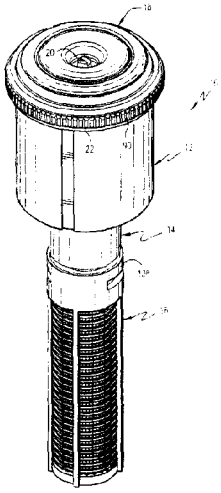

UNITED STATES PATENT AND TRADEMARK OFFICE

CERTIFICATE OF CORRECTION

PATENT NO. : 6,651,905 B2
APPLICATION NO. : 09/818275
DATED : November 25, 2003
INVENTOR(S) : Sesser et al.

It is certified that error appears in the above-identified patent and that said Letters Patent is hereby corrected as shown below:

Column 3, line 37, delete “stem” and insert --stream deflector--.

Column 4, line 38, delete “stem” and insert --stream deflector--.

In the Claims:

Column 17, line 17 (claim 35), delete “steam” and insert --stream deflector--.

Column 21, line 11 (claim 85), delete “stem” and insert --stream deflector--.

Signed and Sealed this

Nineteenth Day of December, 2006

JON W. DUDAS
*Director of the United States Patent and Trademark Office*